United States Patent [19]

Konno et al.

[11] Patent Number: 5,022,792

[45] Date of Patent: Jun. 11, 1991

[54] UNDERGROND CONTINUOUS IMPERVIOUS WALL AND METHOD FOR INSTALLING SAME

[75] Inventors: Shozo Konno; Nobuyuki Matsui, both of Tokyo, Japan

[73] Assignee: Kajima Corporation, Tokyo, Japan

[21] Appl. No.: 460,044

[22] Filed: Jan. 2, 1990

Related U.S. Application Data

[62] Division of Ser. No. 196,617, May 19, 1988, Pat. No. 4,909,674.

[30] Foreign Application Priority Data

| | | | |
|---|---|---|---|
| May 28, 1987 | [JP] | Japan | 63-132218 |
| May 28, 1987 | [JP] | Japan | 63-132219 |
| Jun. 3, 1987 | [JP] | Japan | 63-139497 |
| Jun. 3, 1987 | [JP] | Japan | 63-139498 |
| Jun. 10, 1987 | [JP] | Japan | 63-144951 |

[51] Int. Cl.[5] ..... E02D 5/20

[52] U.S. Cl. ..... 405/267; 405/266; 405/270

[58] Field of Search ..... 405/267, 270, 266, 109, 405/45, 48, 268, 287; 206/494, 820

[56] References Cited

U.S. PATENT DOCUMENTS

| | | | |
|---|---|---|---|
| 3,286,435 | 11/1966 | Weinberger | 206/494 X |
| 3,485,413 | 12/1969 | Vestal | 206/494 X |
| 3,759,044 | 9/1973 | Caron et al. | 405/267 |
| 3,884,355 | 5/1975 | Eriksson | 206/494 |
| 4,484,835 | 11/1984 | van Kunken | 405/270 X |
| 4,519,729 | 5/1985 | Clarke Jr. et al. | 405/267 X |
| 4,582,453 | 4/1986 | Ressi di Cervia | 405/267 X |
| 4,601,615 | 7/1986 | Cavalli | 405/267 |
| 4,664,560 | 5/1987 | Cortlever | 405/267 |
| 4,671,705 | 6/1987 | Nussbaumer et al. | 405/267 |
| 4,697,953 | 10/1987 | Nussbaumer et al. | 405/267 X |
| 4,741,644 | 5/1988 | Cavalli et al. | 405/267 X |
| 4,861,199 | 8/1989 | Hackmack | 405/267 |
| 4,909,674 | 3/1990 | Konno et al. | 405/267 |

*Primary Examiner*—Dennis L. Taylor
*Assistant Examiner*—J. Russell McBee
*Attorney, Agent, or Firm*—James H. Tilberry

[57] ABSTRACT

An underground continuous impervious wall is disclosed, which includes an impervious sheet which partitions a gutter and prevents water from passing through the wall. The gutter is formed in the ground such that it has a small width. The impervious sheet is lowered into the gutter to partition the gutter in the width direction. A hardening material is charged against the opposite side surface of the impervious sheet in the gutter and solidified, whereby an impervious wall with the impervious sheet intervening between opposite side wall portions is obtained. The impervious sheet is disposed in the gutter by lowering the sheet in a state of roll or lowering the sheet in a state stretched on posts or lowering the sheet in a state accommodated in a sheet cartridge. Adjacent sheets are connected to each other by female and male hooks.

4 Claims, 19 Drawing Sheets

UNDERGROND CONTINUOUS IMPERVIOUS WALL AND METHOD FOR INSTALLING SAME

This is a division of application Ser. No. 07/196,617, filed May 19, 1988, now U.S. Pat. No. 4,909,674.

BACKGROUND OF THE INVENTION

1. Field of the Invention

This invention relates to an underground continuous impervious wall and a method for installing the same and, more particularly, to an underground continuous impervious wall obtained by disposing an impervious sheet in a gutter, charging a hardening material on the opposite surfaces of the sheet and hardening the same and a method for efficiently installing the same.

2. Description of the Prior Art

For blocking underground spring water during construction of an underground building or blocking underground water in dam construction works, it has been in practice to construct an underground continuous wall or driving sheet piles and charging a seaming material at the joints.

When such prior art processes are carried out for the purpose of blocking water, there are the following problems.

(a) Underground continuous walls are usually formed such that they have thicknesses more than necessary. Therefore, unnecessarily elabolate works have to be carried out, and also a large quantity of extra concrete has to be used, thus increasing the installation cost.

(b) The process of driving the sheet piles and charging the seaming material at the joints also requires elabolate works and high material cost.

(c) It may be thought to form an underground continuous wall having a reduced thickness to reduce the cost of installation. However, there is no machine for excavating a narrow gutter. Even if such narrow gutter could be excavated, the fluidity of concrete would be spoilt to disable completion of a homogeneous underground wall.

(d) In view of the reliability of water-blocking, concrete walls are subject to formation of cracks at the time of earthquake, thus spoiling the water-blocking property. In the process using precast concrete panels or sheet piles, foreign materials, e.g., bentonite, are trapped so that it is impossible to obtain the sufficient water-blocking property.

An object of the present invention is to provide an underground continuous impervious wall, which can be readily installed, requires inexpensive installation cost and permits construction of an impervious wall having a highly reliable water-blocking property, and a method for installing the same.

SUMMARY OF THE INVENTION

Such underground continuous impervious wall according to the present invention uses an impervious sheet to partition a gutter and prevent water from passing through the wall. A narrow gutter is excavated in the ground. The impervious sheet is lowered into the gutter to partition the gutter in the width direction. A hardening material is charged onto the opposite side surfaces of the impervious sheet in the gutter and hardened. Thus, an impervious wall with the central impervious sheet is formed. As the impervious sheet, polyethylene sheets and other sheets may be used. It is possible to solidify the mud in the gutter using the hardening material or use soil mortar as the hardening material.

There may be thought a plurality of different processes of installing the impervious wall, and also there are several different processes of installing the impervious sheet.

First, the impervious sheet is wound on a winding shaft, and then this sheet roll is lowered vertically into the gutter. Then, the sheet is pulled out from the winding shaft to be laid along the gutter.

In a different mode of the present invention, a plurality of steel posts are used, and the impervious sheet is stretched between adjacent posts. The posts are lowered into the gutter at a predetermined interval to stretch the impervious sheet.

In a further mode of the present invention, the impervious sheet is accommodated in a sheet cartridge to facilitate its stretching in the gutter. The sheet cartridge has a vertically continuous folding groove section formed by a plurality of parallel partition members. The impervious sheet is foldedly accommodated in each folding groove section of the sheet cartridge. The impervious sheet is secured via a space rod detachably provided at a folding portion located at the bottom of each folding groove section in the impervious sheet cartridge. The cartridge with the impervious sheet therein is lowered into the gutter, and the impervious sheet is pulled out to be stretched in the gutter by pulling out the space rods.

By winding the impervious sheet on the winding shaft or stretching the sheet between the posts or lowering the sheet in a state accommodated in the sheet cartridge into the gutter, the sheet can be accurately stretched in the gutter.

The present invention further concerns a process of connecting together adjacent impervious sheets. Adjacent sheets are provided with respective female and male hooks. The female hook is provided on the trailing edge of the impervious sheet. It is vertically continuous in a rail-like form and has a hook-like sectional profile. The male hook has also a hook-like sectional profile. The male hook is engaged in the female hook of the preceding impervious sheet, and the succeeding impervious sheet is lowered to provide a continuous impervious sheet.

The installation works consist of only excavating the gutter, stretching the impervious sheet and solidifying the mud or charging the soil mortar, it is possible to reduce the cost of installation.

Since the completed impervious wall includes the impervious sheet intervening between the opposite side wall portions, generation of cracks in the wall due to an earthquake will not be spoiled the water-blocking property, thus increasing the reliability of water-blocking.

Since the mud is solidified or soil mortar is charged, the entire underground wall may be made homogeneous. Further, if a portion with a reduced mechanical strength is produced, the water-blocking property can be ensured by the impervious sheet.

Further, in case of rock or like earth having satisfactory self-supporting character, the installation cost can be further reduced by using a soft and inexpensive filler, e.g., soil mortar, after the stretching of the sheet.

By winding the impervious sheet on the winding shaft or stretching the sheet between the posts or accommodating the sheet in the sheet cartridge, the sheet can be readily stretched in the gutter without possibility of entangling of the sheet Further, by using the female and male hooks for connecting together the adjacent impervious sheets, the sheets can be readily connected together.

BRIEF DESCRIPTION OF THE DRAWINGS

The other objects and features of the present invention will become apparent from the following description of a preferred embodiment of the invention with reference to the accompanying drawings, in which.

DESCRIPTION OF THE PREFERRED EMBODIMENT

FIGS. 2 to 6 illustrate the process of installing an underground continuous impervious wall according to the present invention. The process will now be described step by step.

(1) Boring

A plurality of bores 1 are bored at a suitable interval in the ground. The bores 1 may not have a fixed diameter. It is possible that only a bore 1, in which a guide post 4 of an excavating apparatus A which will be later described is erected, may have an increased diameter. The boring of the bores 1 is performed while charging mud 3.

When the boring is done in the ground consisting of rock or like earth having satisfactory self-supporting character, mud is unnecessary, and the boring is possible without water.

(2) Excavating apparatus

Figure 7:
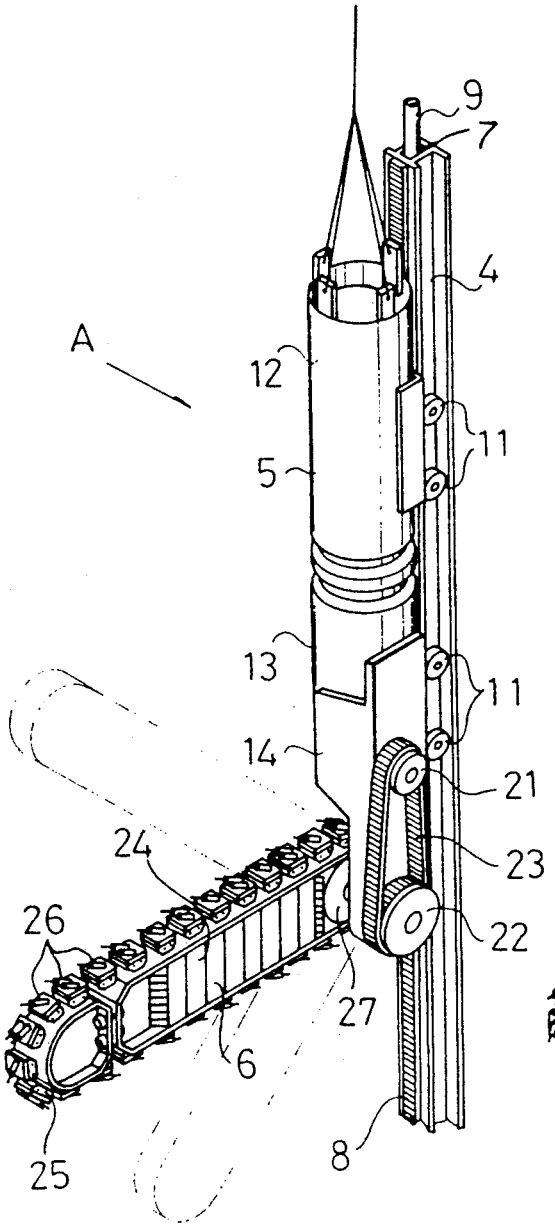
FIG. 7 is a perspective view showing an excavating apparatus.
Figure 8:
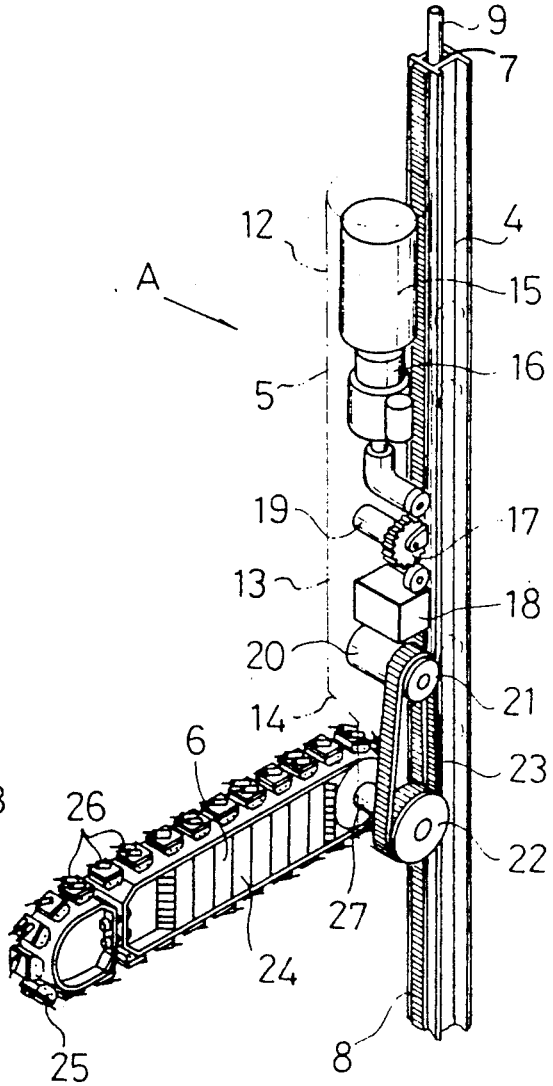
FIG. 8 is a perspective view showing an inner mechanism of the apparatus.

The excavating apparatus A as shown in FIGS. 7 and 8 comprises a guide post 4, a drive unit 5 and a saw unit 6.

The guide post 4 is a hollow pillar-like member having an inner space 7. It has a rack 8 formed on one side over the entire length thereof. A hose 9 for pumping out the mud is passed through the space 7, and mud can be withdrawn through an earth inlet 10 formed at the lower end of the guide post 4.

The drive unit 5 is vertically movable along the guide post 4. The drive unit 5 is provided on its outer periphery with a plurality of guide rollers 11 in engagement with the guide post 4 so that the drive unit 5 is movable along the guide post 4. The drive unit 5 includes a power unit 12, a control unit 13 and an arm 14 for mounting a saw. In the power unit 12, a hydraulic pressure tank 15 and a motor-driven hydraulic power unit 16 are accommodated. A movable sprocket 17 and a control box 18 are accommodated in the control unit 13. The movable sprocket 17 is in mesh with the rack 8 of the guide post 4. A drive motor 19 is driven by the motor-driven power unit 12 to rotate the movable sprocket 17 so as to move the drive unit 5 vertically. In the control unit 13, a saw drive motor 20 is also accommodated, and a saw drive sprocket 21 mounted on the saw-mounting arm 14 is rotated by the motor-driven power unit 12. A saw drive sprocket 22 is mounted on the end of the saw-mounting arm 14, and an endless saw drive chain 23 is passed round the sprocket 22 and saw drive sprocket 21.

The saw unit 6 includes a saw frame 24, a chain 25 and a bit 26. The saw frame 24 has one end rotatably mounted on the saw-mounting arm 14 and rotatable with the saw drive sprocket 22 of the saw-mounting arm 14. The endless chain 25 is rotatably passed round the saw frame 24. The chain 25 has a small width, and it has a plurality of bits 26 secured to its surface constituting the outer periphery of the saw unit 6. The chain 25 is driven for rotation by a chain drive motor 27.

(3) Excavation of gutter

A gutter B having a small width is excavated using the excavating apparatus A as described above. First, the guide post 4 of the excavating apparatus A is erected in the bore 1. The movable sprocket 17 is rotated by the drive motor 19 of the drive unit 5 so that it lowers the drive unit 5 along the rack 8 of the guide post 4 in mesh with the movable sprocket 17. The chain 25 is driven by the chain drive motor 27 so that the chain 25 of the saw unit 6 excavates the gutter B between adjacent bores 1. Since the saw unit 6 has a small width, the gutter B having the small width can be readily excavated.

The excavation is performed while charging the mud into the gutter B. The earth removed by excavation is withdrawn together with the mud through the earth inlet 10 at the lower end of the guide post 4 to be discharged to the outside of the gutter B through the hose 9.

When excavation is difficult, the saw unit 6 is turned to change its angle by driving the saw drive motor 20 and through the saw drive sprocket 21, chain 23 and sprocket 22.

When excavation is done to the same depth as the bore 1, the orientation of the saw unit 6 in the excavating apparatus A is changed or the guide post 4 is erected in the next bore 1 before resuming the excavation.

(4) Stretching of impervious sheet

An impervious sheet C is stretched in the gutter B which has been excavated to a predetermined length in the manner as described above. As the impervious sheet C may be used polyethylene sheets or the like. The impervious sheet C is connected to a joint 28 of the already stretched impervious sheet C to partition the gutter B in the width direction.

(5) Solidification of mud

A hardening material D is charged into the gutter B to solidify the mud 3. As the hardening material, mortar, concrete or the like may be used. When the mud 3 is solidified, an underground continuous impervious wall having a small width is completed, which has the impervious sheet C intervening between the opposite side wall portions.

In the case of rock or like earth having satisfactory self-supporting character, the mud is unnecessary, and excavation without water is possible. After the stretching of the impervious sheet has been completed, soil mortar is charged in lieu of the mud hardener as filler into the gutter.

(6) Other process

FIGS. 9 to 15 show other process, in which the impervious sheet C is lowered in a state wound on a winding shaft into a gutter 1.

Figure 13:
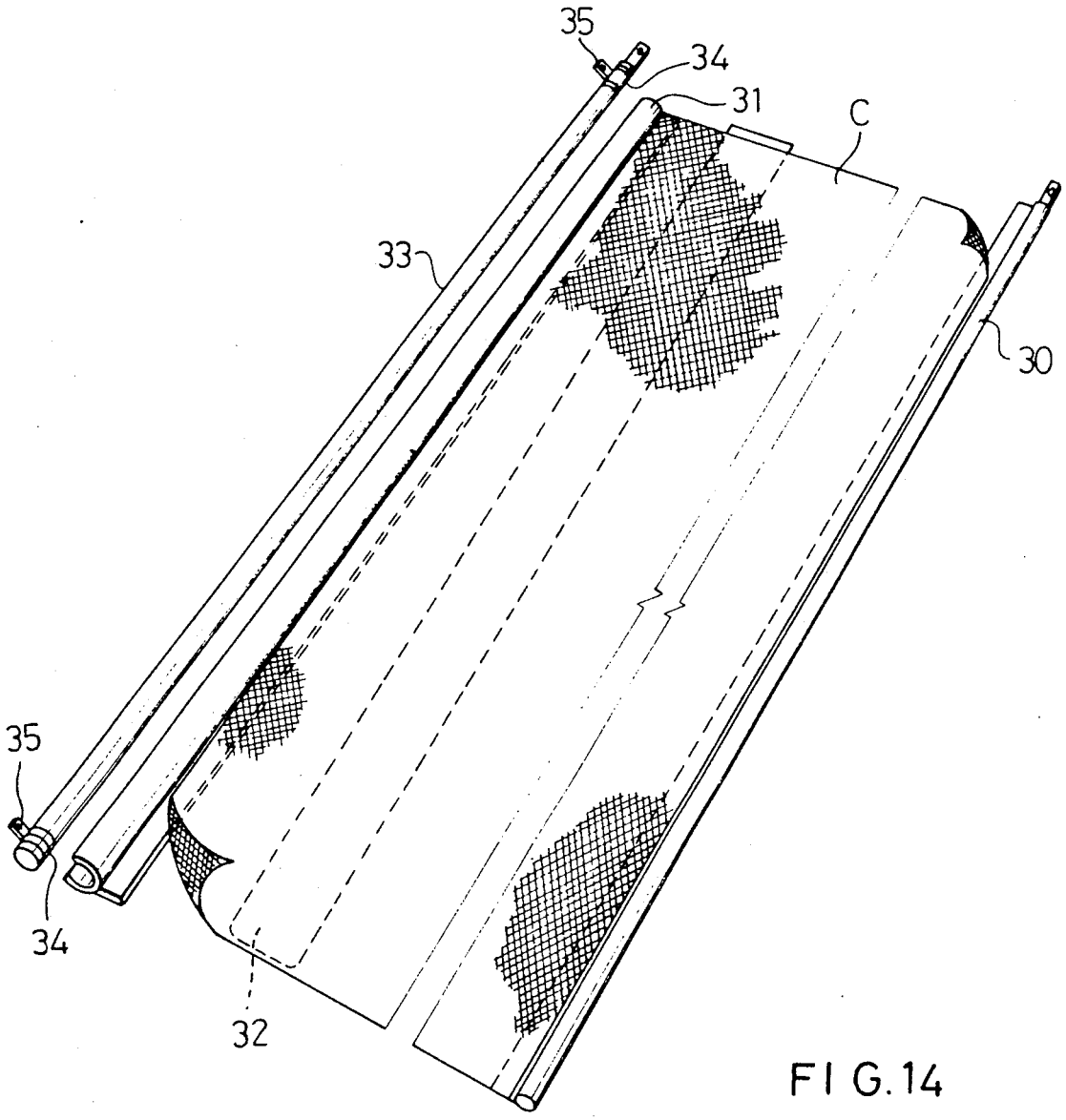
FIG. 13 is a perspective view showing an impervious sheet used for the same process.

One edge of the impervious sheet C is bonded over the entire length to an elongate bar-like sheet joiner 30. To the other end of the sheet C is bonded an elongate sheet joiner 31 having a C-shaped sectional profile. The impervious sheet C has a pocket-like packer 32 sewed to it near the sheet joiner 31. (FIG. 13)

Figure 6:
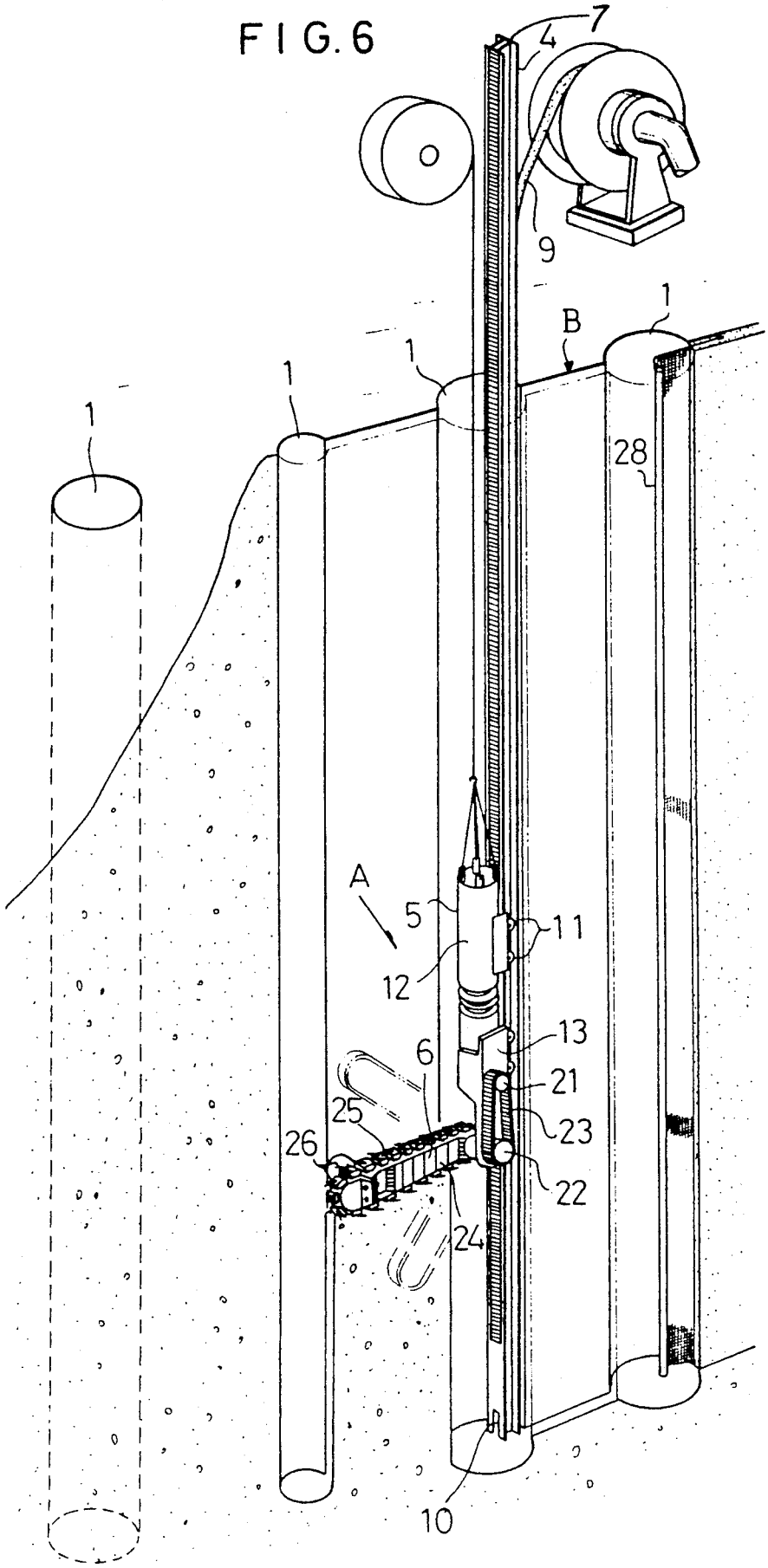

This impervious sheet C is wound on a joiner 33 serving as a winding shaft. The joiner 33 is elongate, and it has rotatable rings 34 each tied to each of the upper and lower ends. Each of the rings 34 has a wire-mounting projection 35. The joiner 33 is fitted in the sheet joiner 31 having a C-shaped sectional profile. The impervious sheet C is wound on the outer periphery of the joiner 33, as shown in FIG. 6.

Figure 15:
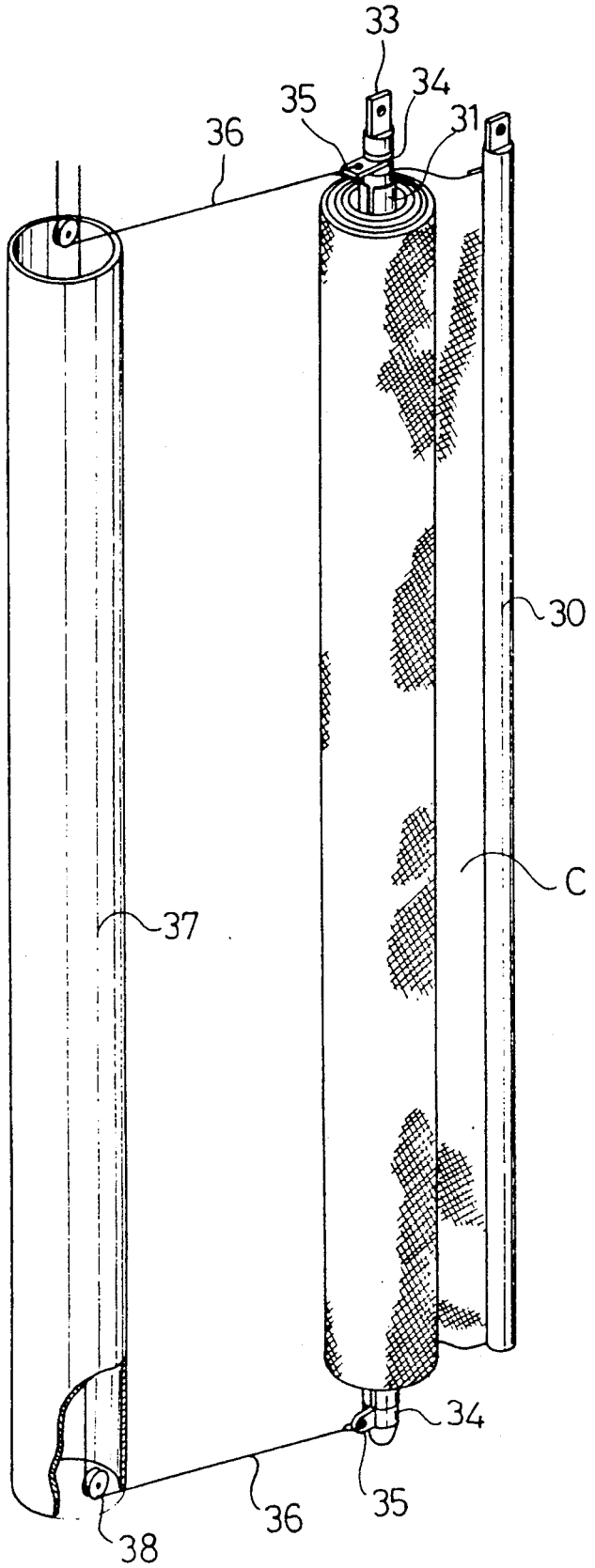
FIG. 15 is a perspective view showing an impervious sheet roll and a post.

Wires 36 are tied to the respective wire-mounting projections 35 of the joiner 33 and passed round shieves 38 in a cylindrical post 37. The wire 36 is stretched upwardly along the post 37 (FIG. 15).

Figure 9A:
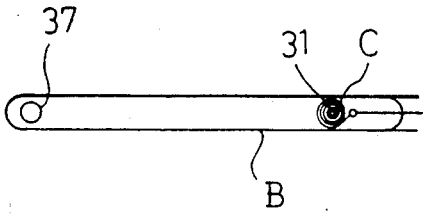
FIGS. 9 to 12 show respectively a different process of installing an underground continuous impervious wall, each having a plan view in I and a sectional view in II.
Figure 9B:
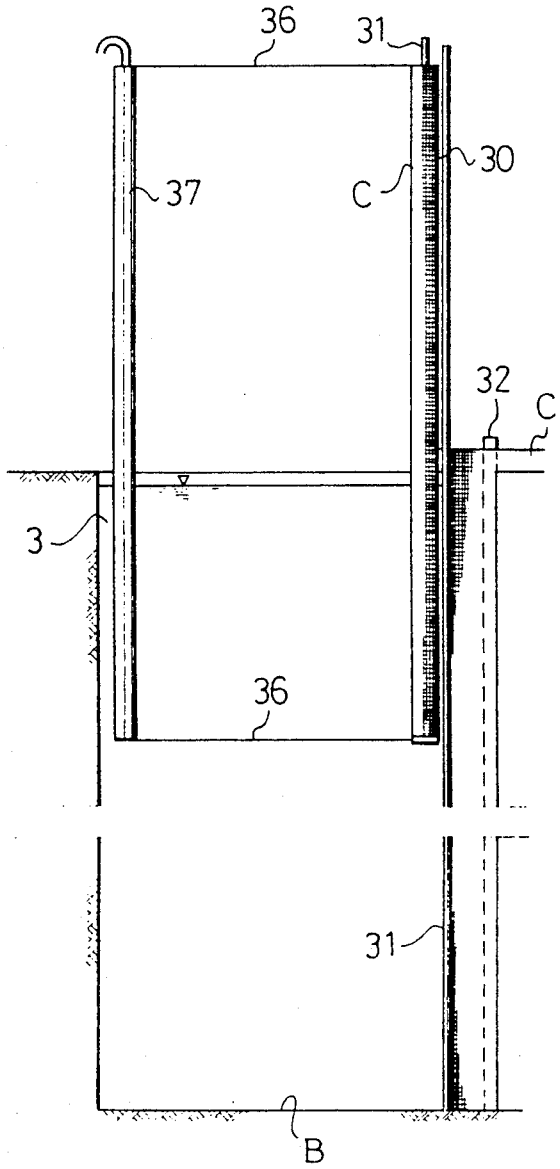

The impervious sheet C is lowered into the gutter B. The impervious sheet C wound on the joiner 33 and post 37 are lowered into the gutter B. The impervious sheet C and post 37 are lowered at a fixed distance from each other. If there is an impervious sheet C which has already been stretched, the newly lowered impervious sheet C is connected to the preceding one by connecting the sheet joiner 31 to the joiner 33 of the preceding one (FIG. 9).

Figure 10A:
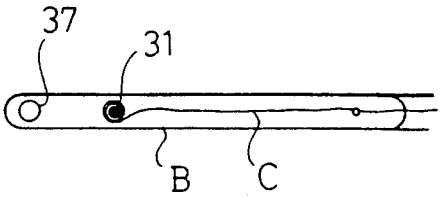
Figure 10B:
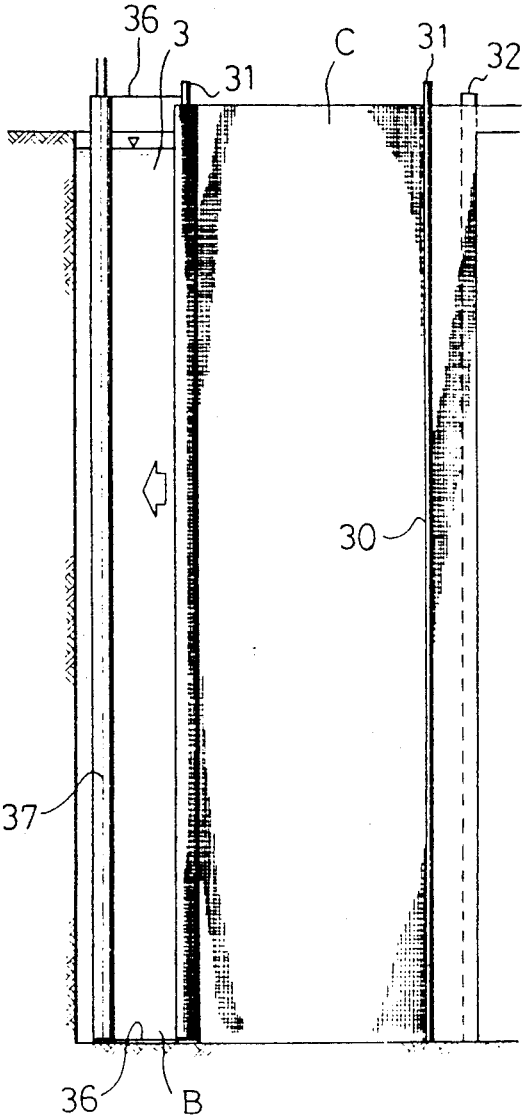

The joiner 33 serving as the winding shaft is pulled toward the post 37 by pulling the wires 36 stretched upwardly along the post 37. The impervious sheet C is paid off by displacing the joiner 33 so that it is stretched in the gutter B to partition the gutter B in the width direction thereof. (FIG. 10).

Figure 11A:
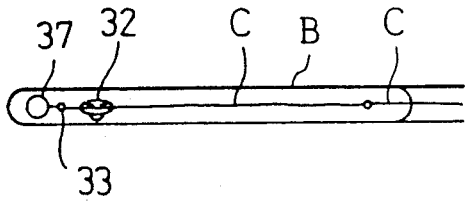
Figure 11B:
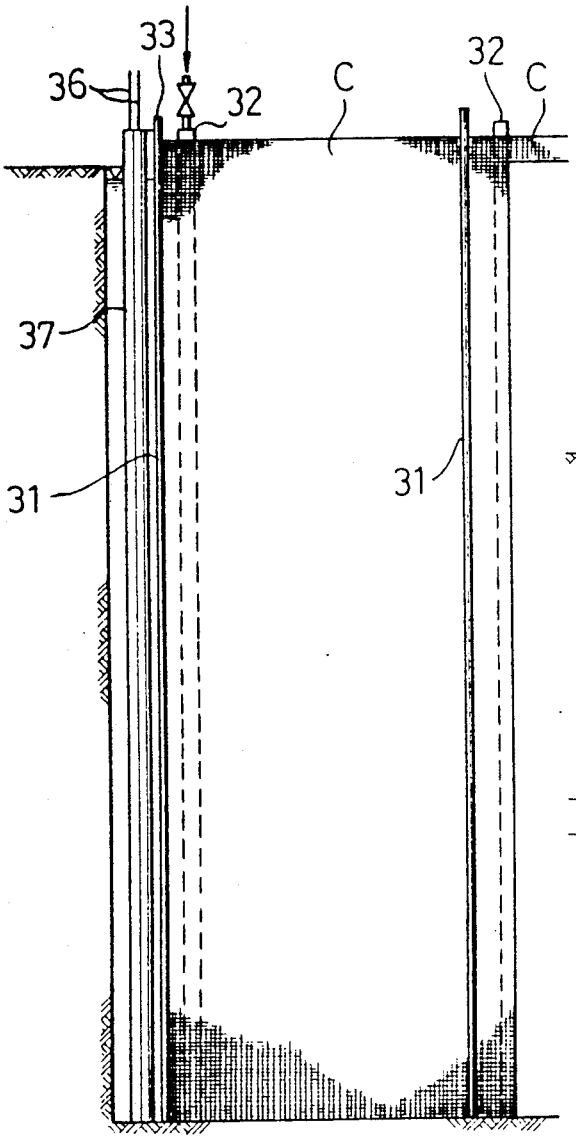

The gutter B is partitioned by charging water or air into the sewed packer 32 of the impervious sheet C (FIG. 11).

Figure 12A:
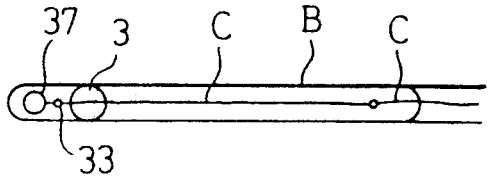
Figure 12B:
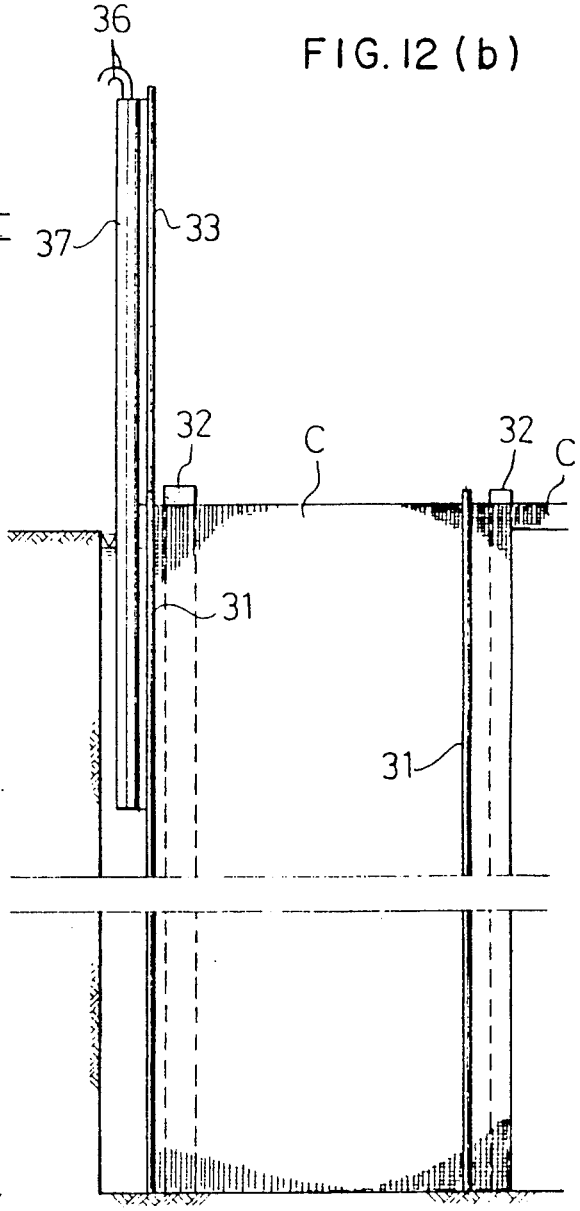

A hardening material, e.g., mortar or concrete, is charged into the mud 3 in the gutter B partitioned by the packer 32 to solidify the mud, thus obtaining the impervious wall (FIG. 12).

After the mud has been solidified, the post 37 and joiner 33 are pulled out from the gutter 1.

In the case of rock or like earth having satisfactory self-supporting character, the mud is unnecessary, and excavation without water is possible. After the stretching of the impervious sheet has been completed, soil morter is charged in lieu of the mud hardener as filler into the gutter.

Figure 16A:
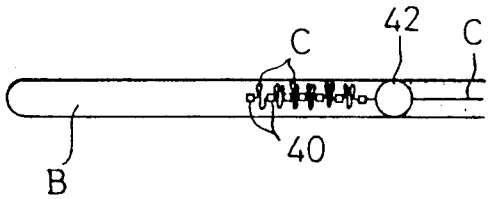
FIGS. 16 to 18 show respectively a further process of installing an underground continuous impervious wall, each having a plan view in I and a sectional view in II.
Figure 17A:
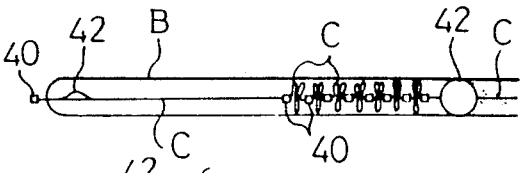
Figure 16B:
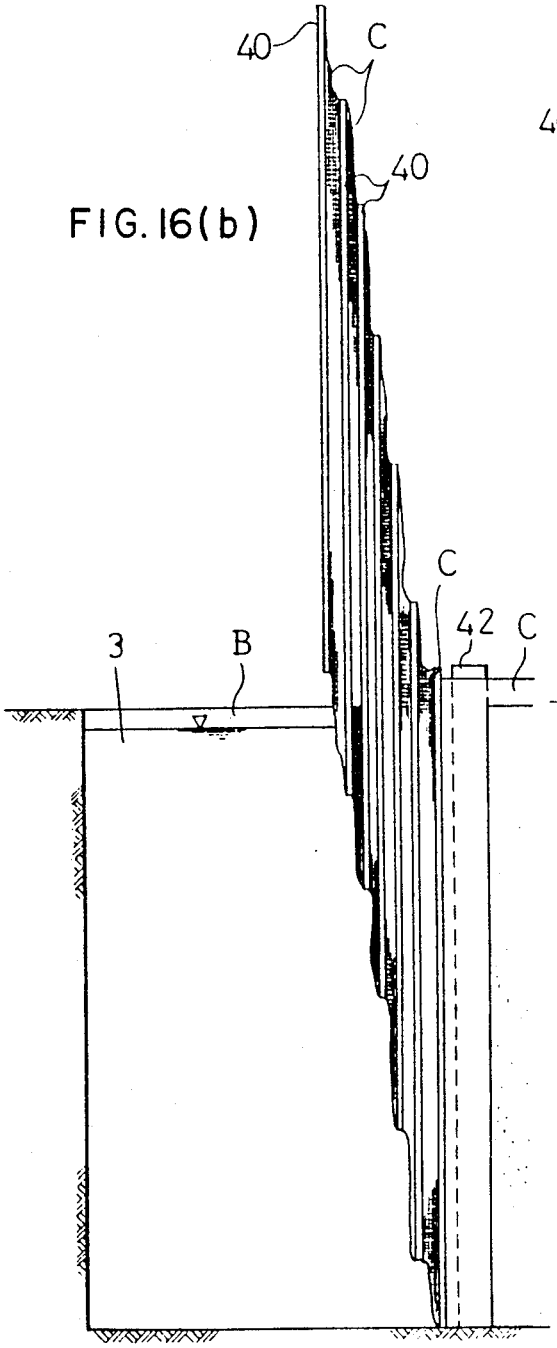
Figure 17B:
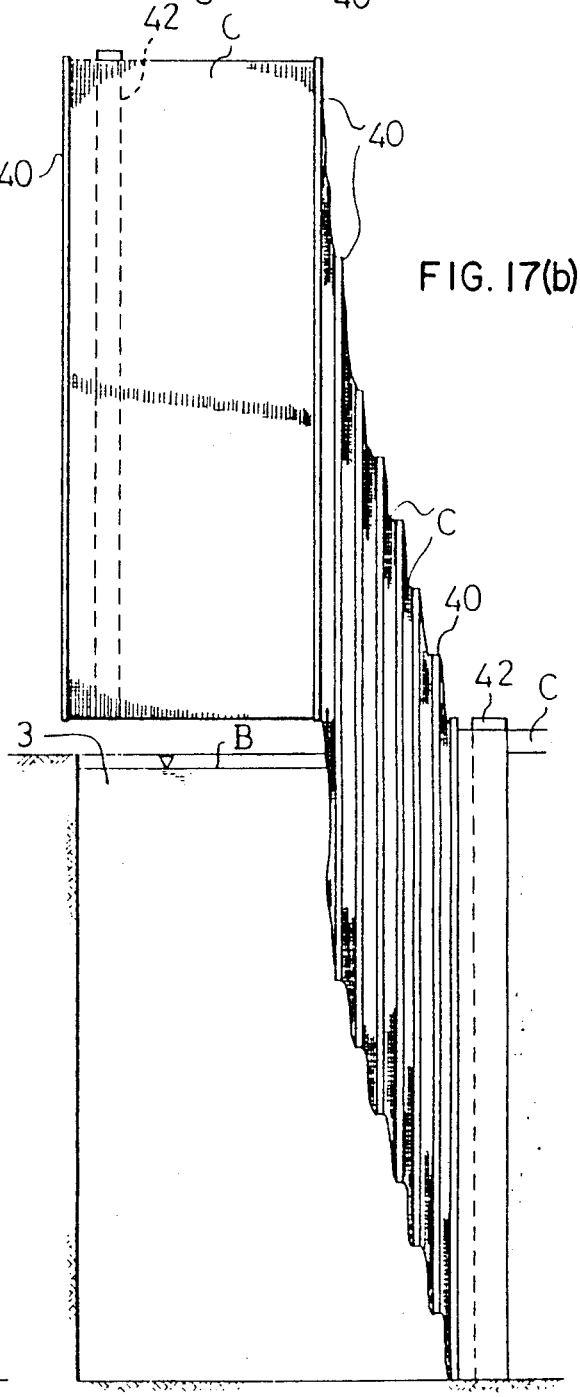
Figure 18A:
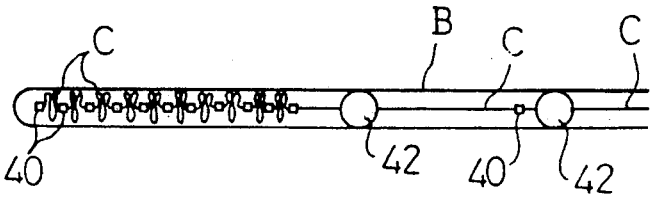
Figure 18B:
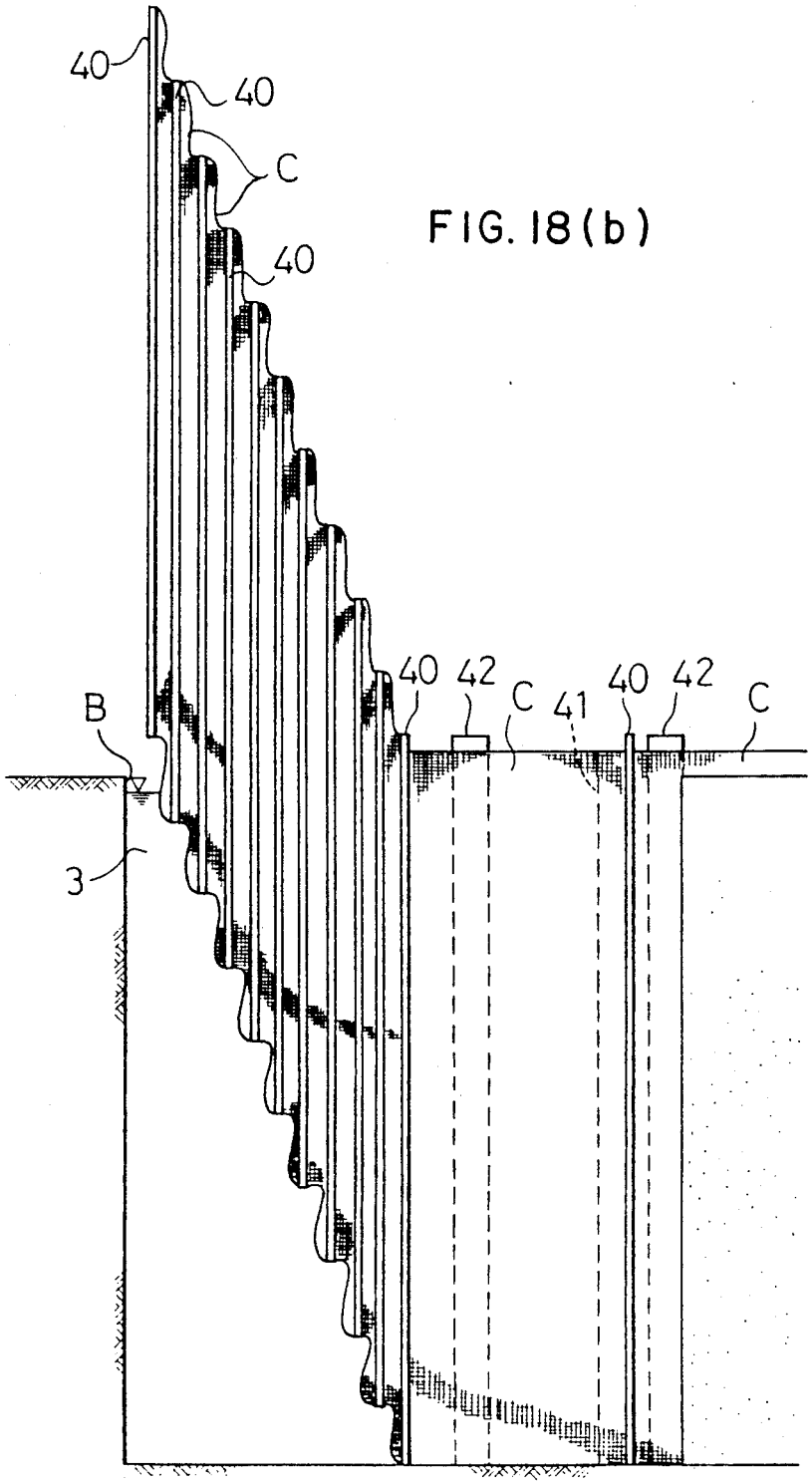

FIGS. 16 to 18 show a further process, in which the impervious sheet C is lowered in a state stretched between posts into the gutter.

As posts 40, it is possible to use H shape steel. The post 40 is secured to either left or right end of one impervious sheet C. Fasteners 41 are tied to the opposite ends of the sheet C over the entire length. A pocket-like packer 42 is sewed to the impervious sheet C near the post 40. A plurality of impervious sheets C are tied to one another by the fasteners 41.

The impervious sheet C is lowered in a folded state together with the post 40 into the gutter B. A require number of impervious sheets C corresponding to the length of the gutter B are paid off to partition the gutter B in the width direction thereof.

Further, additional impervious sheets C are tied together by the fasteners 41, as shown in FIG. 18.

FIGS. 19 to 33 show a still further process, in which the impervious sheet is lowered in a state accommodated in a sheet cartridge into the gutter B.

In the Figures, reference numeral 60 designates the sheet cartridge. The cartridge 50 consists of a base 51 having a semi-circular sectional profile. Inside the base 51, a vertically continuous folding groove 53 is formed by a plurality of parallel partition members 51. A bar-like guide member 54 is secured to the free end of each partition member 52. The cartridge 50 has a bottom 55 formed at the lower end and consisting of an expandable metal. Partitioning retainers 56 are secured to the bottom 55 near the base 51 to partition the folding groove 53.

In the Figures, reference symbol C designates the impervious sheet, e.g., a polyethylene sheet. As shown in FIG. 11, the impervious sheet C has an elongate bar-like sheet joiner 58 secured to one end and a sheet joiner 59 having a C-shaped sectional profile and secured to the other end. The impervious sheet C also has a pocket-like cover 60 bonded to it near the sheet joiner 59. An elongate sac-like packer 61 is inserted in the cover 60.

The above impervious sheet C is accommodated in a folded state in the folding groove 53 of the sheet cartridge 50. Each folded portion of the impervious sheet C is located at the bottom of each section of &he folding groove 53. In the folded portion, a space rod 62 is provided between each partitioning retainer 56 and the base 51 to prevent detachment of the impervious sheet.

Figure 31:
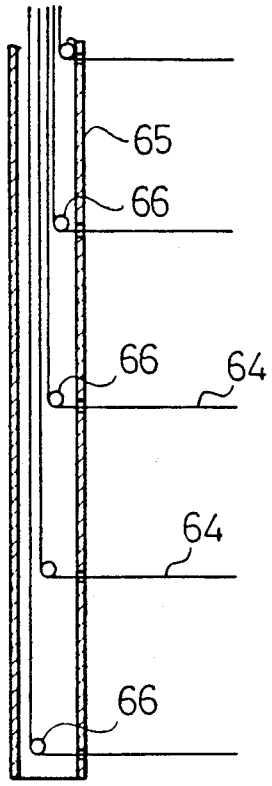
FIG. 31 is a sectional view showing a steel pipe.
Figure 33:
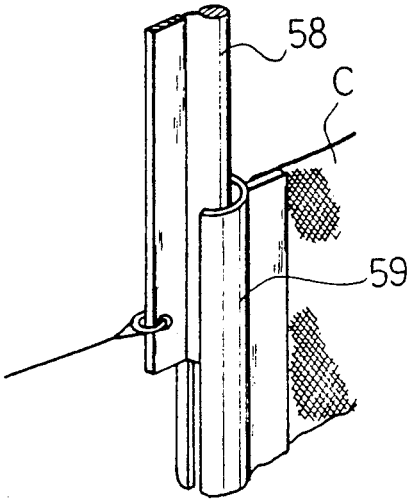
FIG. 33 is a view showing a connection of the impervious sheet and a joiner.

The impervious sheet C is lowered into the gutter B. At this time, the impervious sheet C is lowered in a state secured to the sheet cartridge 50 into the gutter B. The elongate joiner 58 is fitted in the sheet joiner 59 of the impervious sheet C (FIG. 33). A plurality of wires 64 are tied to the joiner 58, and they are passed round shieves 66 in a post 65 consisting of a steel pipe to be pulled upwards (FIG. 31).

Figure 20:
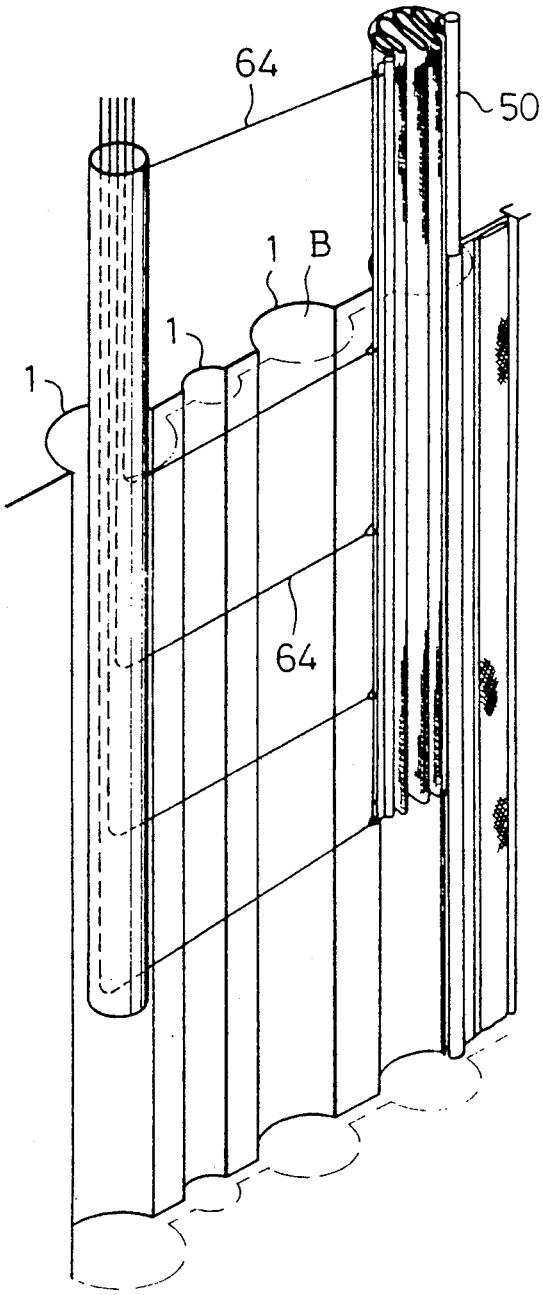

When lowering the sheet cartridge 50 into the gutter B, the post 65 is also lowered into the gutter B such that it is parallel to the cartridge (FIG. 20). If there is an already stretched impervious sheet C in the gutter B, the new pervious sheet C is lowered with its sheet joiner 59 engaged in the sheet joiner 58 of the preceding sheet, whereby the two sheets C are joined together by the sheet joiners 58 and 59.

After the sheet has been lowered, the wires 64 passed through the post 65 are pulled to pull the lowered impervious sheet C. At this time, the space rods 62 are withdrawn one by one so that the impervious sheet C is ready for being paid off from the folding groove 53 as shown in (I) and (II) in FIG. 27.

Figure 22:
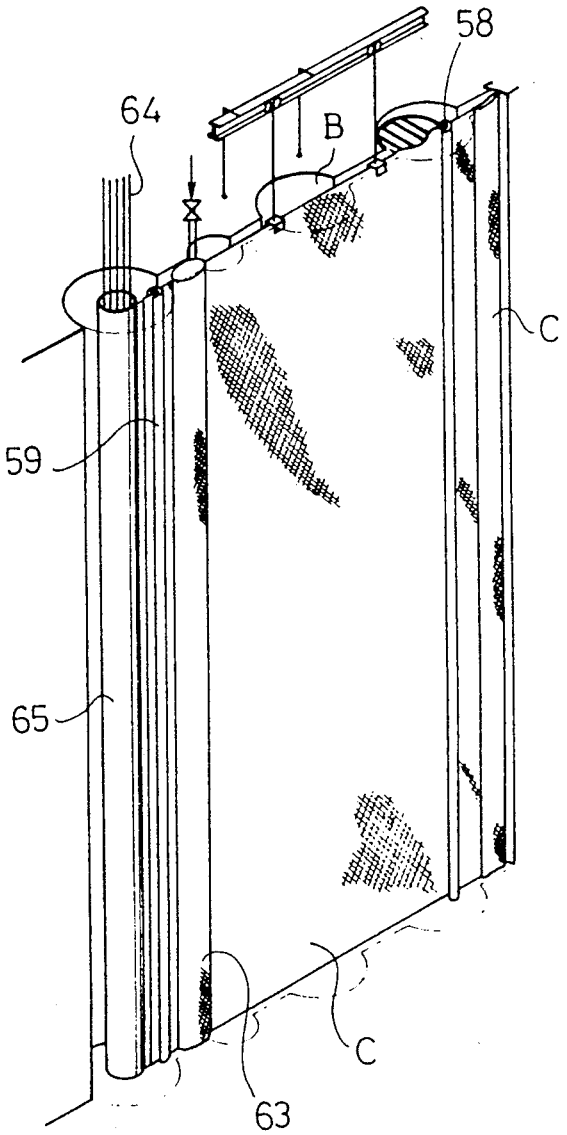

The impervious sheet C is stretched in the gutter B in the manner as described above such that it partitions the gutter B in the width direction thereof (FIG. 22).

Then air or water is charged into the packer 66 of the stretched impervious sheet C to partition the gutter B. Then the hardening material D is poured into the gutter B partitioned by the packer 66 to solidify the mud 3.

Figure 34:
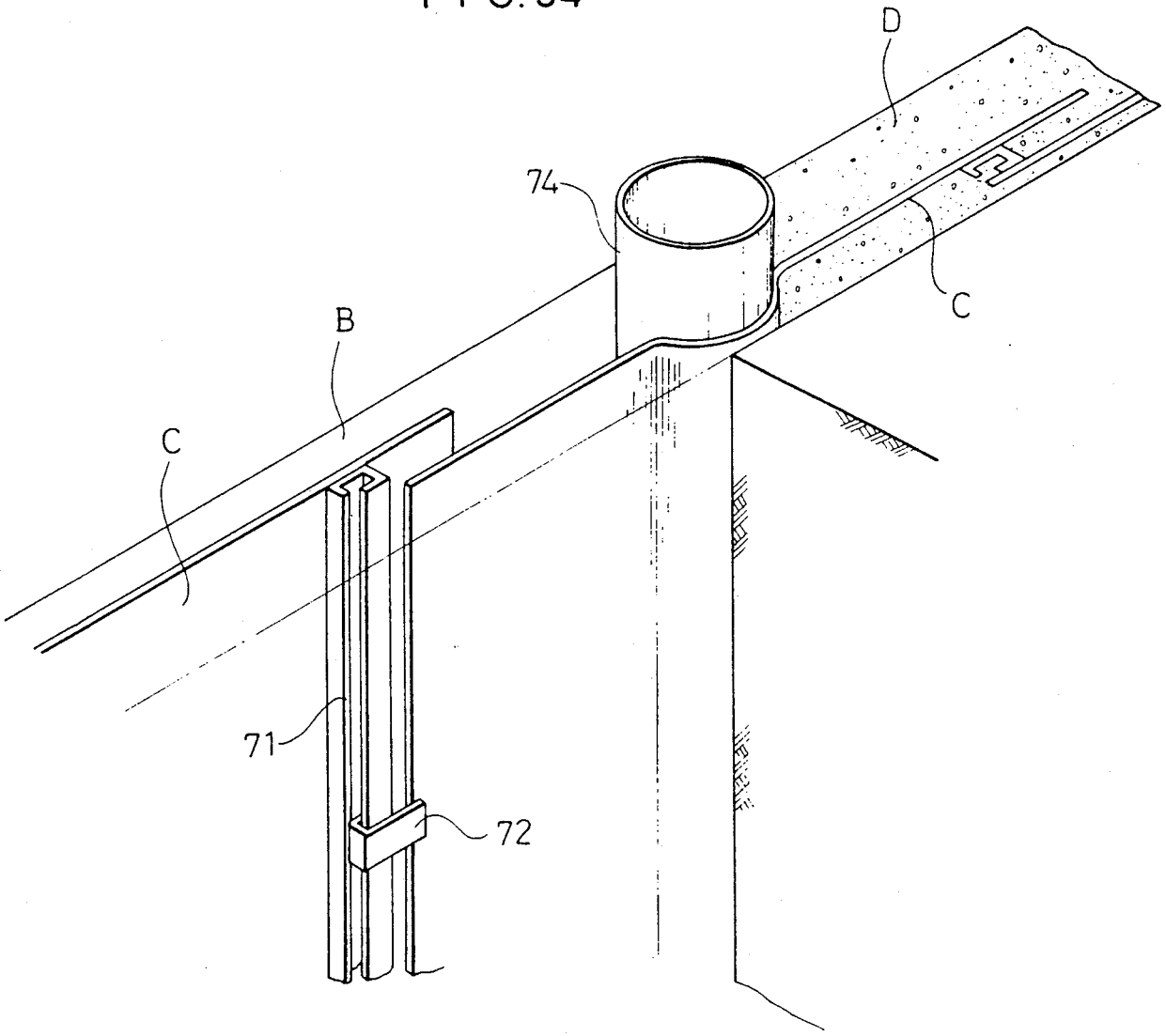
FIGS. 34 to 36 show respectively a further process of installing an underground continuous impervious wall with FIG. 34 being a perspective view, FIG. 35 being a plan view and FIG. 36 being a plan view showing a connection of adjacent impervious sheets.
Figure 35:
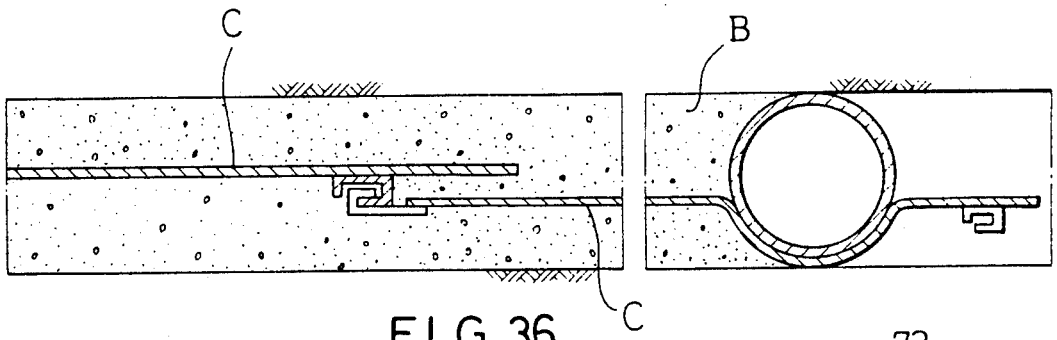
Figure 36:
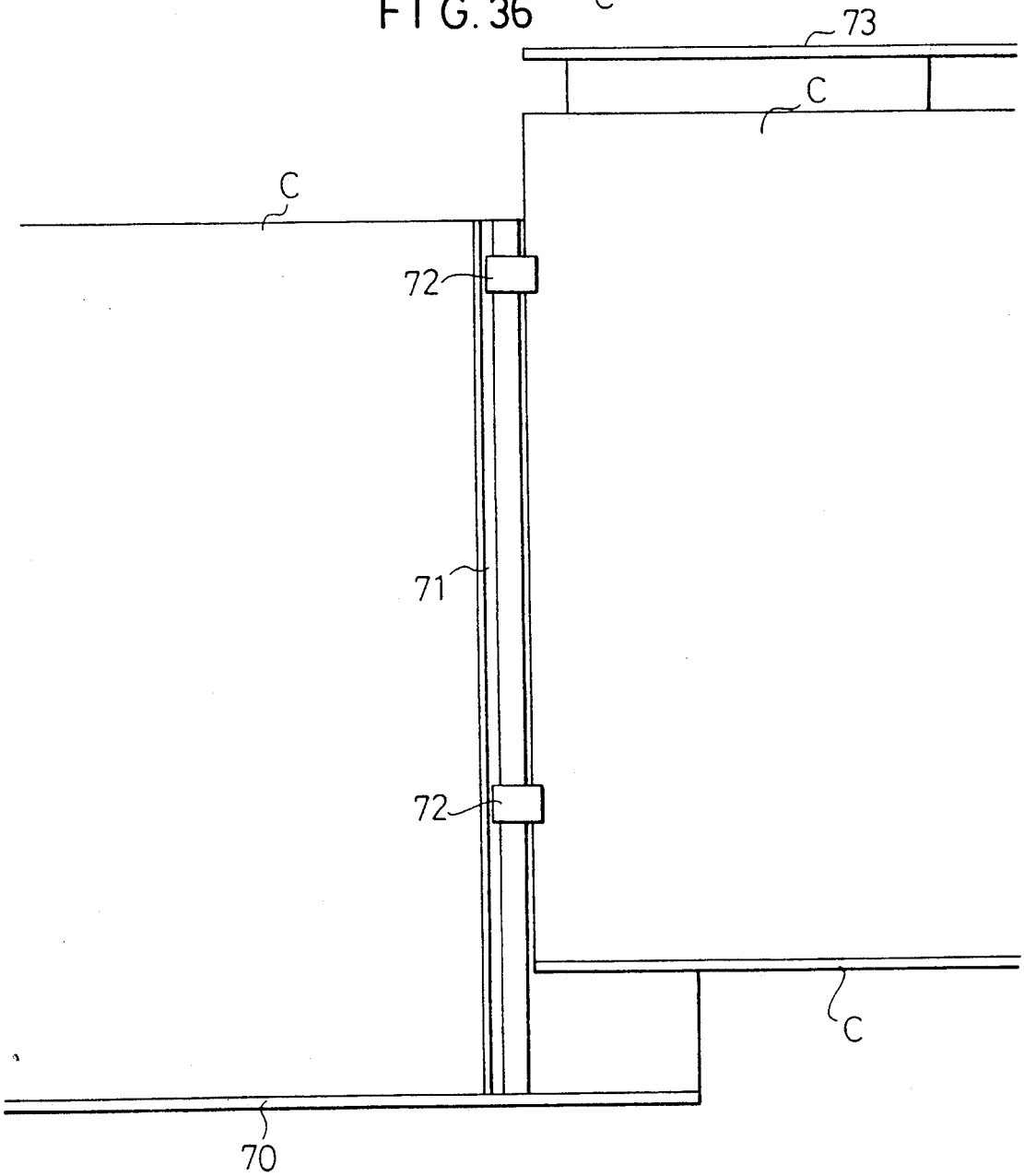

FIGS. 34 to 36 show a method for connecting the impervious sheets C. A bar-like weight 70 is secured to the lower end of the impervious sheet C over the entire length of the lower end. A plurality of impervious sheets C are introduced one by one into the gutter B. The trailing end of the preceding impervious sheet C is provided with a vertically continuous female hook 71 having a hook-like sectional profile. To the leading end of the impervious sheet C is secured a male hook 72 having a hook-like sectional profile. In this embodiment, a plurality of male hooks are provided, but it is also possible to provide a single, vertically continuous hook.

The impervious sheet C is lowered in a state suspended from a bar-like hanger 73 into the gutter B by a crane or the like. When introducing the impervious sheet C subsequent to the preceding impervious sheet C into the gutter B, the male hook 72 of the succeeding impervious sheet C is engaged in the female hook 71 of the preceding impervious sheet C.

In the above way, a plurality of impervious sheets C are introduced continuously into the gutter B to partition the gutter B in the width direction thereof.

When solidifying the mud, the gutter B is partitioned by driving locking pipes 74 in order that a given solidification range is provided lest the mud should be solidified in range where there are the hooks 71 and 72.

What is claimed is:

1. In a slit trench having opposed walls, the method for installing an underground water-improvement wall comprising the steps of:

(a) placing a series of interconnected sheets of water-impervious membrane in said slit trench;

(b) positioning first and second supporting rods vertically in said slit trench;

(c) vertically suspending said sheets between said first and second supporting rods;

(d) sequentially positioning and tensioning each sheet in said trench;

(e) securing one vertical edge of each said sheet to said first supporting rod;

(f) securing the opposite vertical edge of said sheet to said second supporting rod;

(g) anchoring said first supporting rod;

(h) shifting said second supporting rod away from said first supporting rod to tension said sheet;

(i) securing a vertically elongated bladder pocket to at least one of said sheets;

(j) placing a vertically elongated inflatable bladder in said pocket; and (k) inflating said bladder to laterally expand said bladder pocket sufficiently to create a dam between said opposed trench walls.

2. The method of constructing an underground water-impervious wall in a slit trench comprising the steps of:

(a) boring a plurality of holes at preselected intervals along the center line of the proposed wall;

(b) charging said holes with fluidized mud simultaneously with the boring thereof;

(c) placing a hollow tube in one of said bore holes positioned to receive a slurry of excavated earth and mud into the bottom of said tube and to discharge said slurry out of the top of said tube;

(d) mounting a cantilevered excavating head on said tube adapted to excavate the earth between a pair of bore holes and to transport said earth into said bore hole containing said hollow tube;

(e) urging said cantilevered excavating head downwardly along said tube until all earth has been excavated between said pair of bore holes;

(f) consecutively excavating the earth between said holes to form a continuous slit trench while simultaneously charging said slit trench portion so formed with fluidized mud;

(g) removing a slurry of fluidized mud and excavated earth from said slit trench;

(h) continuously replacing the slurry removed from said trench during excavation with fluidized mud;

(i) positioning and stretching in a vertical plane a water-impervious membrane throughout said fluidized mud-filled trench; and (j) charging a substance on opposite sides of said membrane to harden said fluidized mud.

3. The method of claim 2 wherein said membrane is comprised of a plurality of sheets of membrane, and including the steps of:

(a) consecutively positioning said plurality of sheets of membrane in edge-to-edge continuous, unbroken, longitudinal alignment throughout said trench;

(b) stretching each sheet prior to connecting said sheet to a consecutively adjacent next sheet; and (c) connecting adjacent edges of said sheets to form a continuous sheet of membrane.

4. The method of claim 2, wherein said cantilevered excavating head comprises a rotating chain with cutting teeth secured thereto, said chain being mounted to rotate on a rigid mandrel vertically shiftably secured to said hollow tube, and of sufficient length to fully excavate between bore holes, including the steps of:

(a) horizontally positioning said mandrel;

(b) rotating said chain on said mandrel;

(c) urging said mandrel downwardly to engage and to excavate earth laterally into said hollow tube-containing bore hole to form a slurry of fluidized mud and earth;

(d) withdrawing said slurry up the interior of said hollow tube;

(e) discharging said slurry remote from said trench; and (f) replacing fluidized mud into said trench at the same volumetric rate as the rate at which said slurry is removed from said bore hole.

* * * * *

UNITED STATES PATENT AND TRADEMARK OFFICE
CERTIFICATE OF CORRECTION

PATENT NO. : 5,022,792

DATED : June 11, 1991

INVENTOR(S) : Shozo Konno, et al

It is certified that error appears in the above-identified patent and that said Letters Patent is hereby corrected as shown below:

The title page should be deleted to appear as per attached title page. The sheets consisting of cols. 1-10, should be deleted to be replaced with cols. 1-10 as per attached sheets.

Signed and Sealed this

Twenty-second Day of December, 1992

*Attest:*

DOUGLAS B. COMER

*Attesting Officer*

*Acting Commissioner of Patents and Trademarks*

United States Patent [19]

Konno et al.

[11] Patent Number: 5,022,792

[45] Date of Patent: Jun. 11, 1991

[54] UNDERGROND CONTINUOUS IMPERVIOUS WALL AND METHOD FOR INSTALLING SAME

[75] Inventors: Shozo Konno; Nobuyuki Matsui, both of Tokyo, Japan

[73] Assignee: Kajima Corporation, Tokyo, Japan

[21] Appl. No.: 460,044

[22] Filed: Jan. 2, 1990

Related U.S. Application Data

[62] Division of Ser. No. 196,617, May 19, 1988, Pat. No. 4,909,674.

[30] Foreign Application Priority Data

| | | | |
|---|---|---|---|
| May 28, 1987 | [JP] | Japan | 63-132218 |
| May 28, 1987 | [JP] | Japan | 63-132219 |
| Jun. 3, 1987 | [JP] | Japan | 63-139497 |
| Jun. 3, 1987 | [JP] | Japan | 63-139498 |
| Jun. 10, 1987 | [JP] | Japan | 63-144951 |

[51] Int. Cl.[5] ..... E02D 5/20

[52] U.S. Cl. ..... 405/267; 405/266; 405/270

[58] Field of Search ..... 405/267, 270, 266, 109, 405/45, 48, 268, 287; 206/494, 820

[56] References Cited

U.S. PATENT DOCUMENTS

| | | | |
|---|---|---|---|
| 3,286,435 | 11/1966 | Weinberger | 206/494 X |
| 3,485,413 | 12/1969 | Vestal | 206/494 X |
| 3,759,044 | 9/1973 | Caron et al. | 405/267 |
| 3,884,355 | 5/1975 | Eriksson | 206/494 |
| 4,484,835 | 11/1984 | van Kunken | 405/270 X |
| 4,519,729 | 5/1985 | Clarke Jr. et al. | 405/267 X |
| 4,582,453 | 4/1986 | Ressi di Cervia | 405/267 X |
| 4,601,615 | 7/1986 | Cavalli | 405/267 |
| 4,664,560 | 5/1987 | Cortlever | 405/267 |
| 4,671,705 | 6/1987 | Nussbaumer et al. | 405/267 |
| 4,697,953 | 10/1987 | Nussbaumer et al. | 405/267 X |
| 4,741,644 | 5/1988 | Cavalli et al. | 405/267 X |
| 4,861,199 | 8/1989 | Hackmack | 405/267 |
| 4,909,674 | 3/1990 | Konno et al. | 405/267 |

*Primary Examiner*—Dennis L. Taylor
*Assistant Examiner*—J. Russell McBee
*Attorney, Agent, or Firm*—James H. Tilberry

[57] ABSTRACT

An underground continuous water-impervious wall is disclosed, which includes a water-impervious membrane to partition a trench and to prevent water from passing through the wall. The trench as formed in the ground has a narrow width. The impervious sheet is lowered into the trench to partition the trench longitudinally. A hardening material is charged against the opposite side surfaces of the impervious sheet in the trench and solidified, whereby a water-impervious wall is obtained, with the impervious sheet sandwiched between opposite side wall portions. The impervious sheet is disposed in the trench by lowering the sheet in the form of a roll, lowering the sheet pre-stretched between posts, or lowering a pleated sheet pre-packed in a sheet cartridge. Adjacent sheets are connected to each other by female and male fasteners.

4 Claims, 19 Drawing Sheets

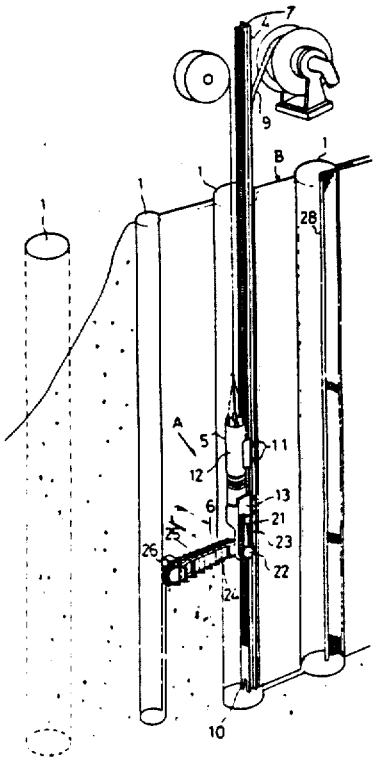

UNDERGROND CONTINUOUS IMPERVIOUS WALL AND METHOD FOR INSTALLING SAME

This is a division of application Ser. No. 07/196,617, filed May 19, 1988 now U.S. Pat. No. 4,909,674.

This invention relates to construction of an underground continuous waterproof wall and a method for installing the same. More particularly, the invention relates to an underground continuous water-impervious wall obtained by vertically positioning a series of interconnected water-impervious plastic membranes in a slit trench, charging a hardening material on the opposite surfaces of the membranes and hardening the same.

DESCRIPTION OF THE PRIOR ART

For blocking underground spring water during construction of an underground building or blocking underground water in dam construction works, it has been a practice to construct an underground continuous wall by driving piling and charging a seaming material at the joints. Such prior art processes are unsatisfactory for several reasons.

Prior art water damming walls are usually thicker than necessary because there have been no means for excavating narrow trenches. Therefore, unnecessarily elaborate forms must be prepared, and an excessive quantity of concrete has to be used to fill these forms. This increases the installation cost. Also, the process of driving the piling and charging the seaming material at the joints requires elaborate preparation and high cost of material and labor. Even if a sufficiently narrow trench could be excavated, concrete is not sufficiently fluid to permit the pouring of a homogeneous underground wall. In addition, water-damming concrete walls are vulnerable to cracking caused by earthquake tremors, thus destroying the water-blocking property of the wall.

SUMMARY OF THE INVENTION

The underground continuous water-impervious wall according to the present invention uses a water-impervious plastic membrane to partition a narrow slit trench and to prevent water from passing through the wall. The trench is excavated in the ground by special and novel excavating equipment. The impervious membrane is lowered into the trench to longitudinally partition the trench into two parts. A hardening material is charged onto the opposite side surfaces of the impervious sheet and permitted to harden. Thus, a laminated wall is formed with its center comprised of a polyolefin plastic sheet, such as polyethylene, or any other impervious membrane. The invention contemplates a plurality of different processes for installing the impervious wall, and there are also several different processes for installing the impervious sheet.

First, the impervious sheet is wound on a roller, and then this sheet roll is lowered vertically into the trench. Then the sheet is unwound from the roller to extend along the trench.

In another embodiment of the present invention, a plurality of steel posts are used, and the impervious sheet is stretched between adjacent posts. The posts are lowered into the trench at a predetermined interval to stretch the impervious sheet.

In a further embodiment of the present invention, the impervious sheet is housed in a cartridge to facilitate its stretching in the trench. The cartridge has a vertically continuous folding groove section formed by a plurality of parallel partition members. The impervious sheet is foldedly accommodated in each folding groove section of the cartridge. The impervious sheet is secured via a space rod detachably provided at a folding portion located at the bottom of each folding groove section in the impervious cartridge. The cartridge with the impervious sheet therein is lowered into the trench, and the impervious sheet is pulled out to be stretched in the trench by pulling out the space rods.

By unwinding the impervious sheet from a roller or stretching the sheet between posts or lowering the sheet in the cartridge into the trench, the sheet can be accurately stretched in the trench.

The present invention further contemplates a process for connecting together adjacent impervious sheets. Adjacent sheets are provided with respective female and male fasteners. The female and male fasteners are provided on the trailing and leading edges, respectively, of the impervious sheet. The fasteners are vertically continuous in a rail-like form and have hook-like sectional profiles. The male fastener is engaged in the female fastener of the preceding impervious sheet, and the succeeding impervious sheet is lowered to provide a continuous impervious sheet.

The installation work consists of excavating the trench, stretching the impervious sheet and solidifying the mud or charging the soil mortar.

Since the completed impervious wall includes the impervious sheet intervening between the opposed hardened side wall portions, cracks in the wall due to earthquake tremors will not cause the wall to leak so long as the intervening sheet is not ruptured. Further, even if a portion of the wall of reduced mechanical strength is produced, the water-impervious sheet will maintain the integrity of the water-damming function of the wall.

Further, in case of soil formations having satisfactory self-supporting characteristics, the installation cost can be further reduced by using a soft and inexpensive filler, e.g., soil mortar, after the stretching of the sheet.

By winding the impervious sheet on a roller or stretching the sheet between posts or packaging the sheet in a pleated sheet cartridge, the sheet can be readily stretched in the trench without possibility of entangling of the sheet.

Further, by using female and male fasteners for connecting together the adjacent impervious sheets, the integrity of the water seal is maintained from sheet to sheet.

OBJECTS OF THE INVENTION

It is among the objects of the invention to provide a waterproof underground retaining wall adapted to protect a construction site from water seepage.

It is another object of the invention to provide a waterproof underground retaining wall that is laminated with a water-impervious membrane.

It is a further object of the invention to provide a waterproof underground retaining wall in which a water-impervious membrane is sandwiched with a hardening substance on each side of the membrane.

It is another object of the invention to provide a waterproof underground retaining wall that will retain its water damming properties even if cracked due to earthquake tremors.

It is another object of the invention to provide novel means of constructing a thin, lightweight, waterproof underground wall.

It is a further object of the invention to provide novel means of installing a thin, lightweight, waterproof underground retaining wall in a narrow slit trench.

It is a still further object of the invention to provide a novel waterproof underground retaining wall membrane in sections which may be joined together with novel fastener means adapted to maintain the waterproof integrity of the wall.

BRIEF DESCRIPTION OF THE DRAWINGS

Figure 1:
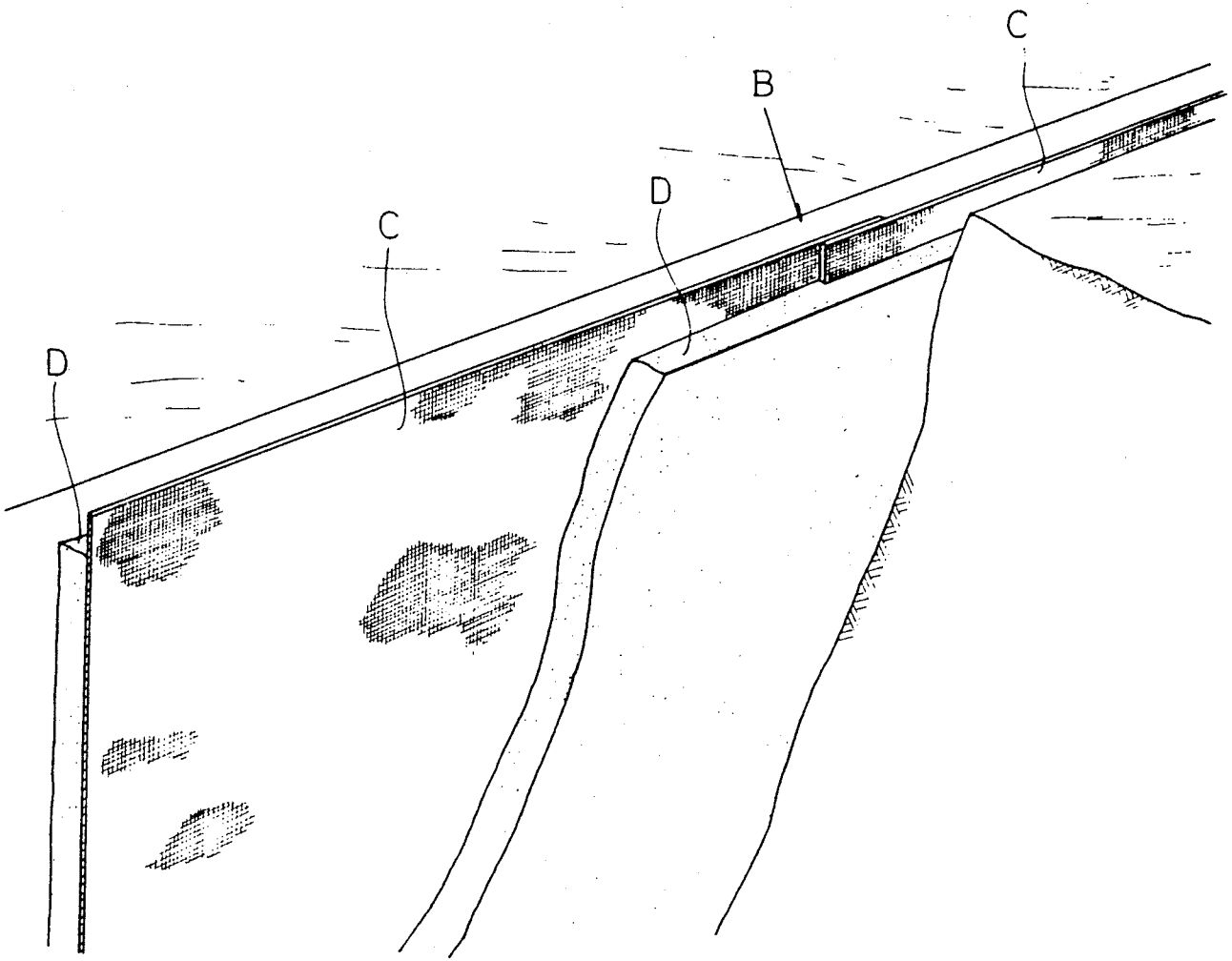
FIG. 1 is a view showing an underground continuous impervious wall.
Figure 2:
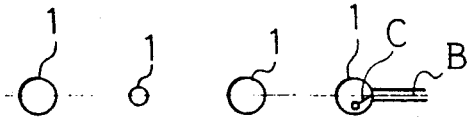
FIGS. 2 to 6 show respectively a process of installing the wall with FIGS. 2 to 5 each having a plan view in I and a sectional view in II and FIG. 6 being a perspective view.
Figure 3A:
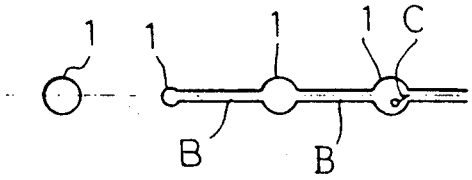
Figure 2B:
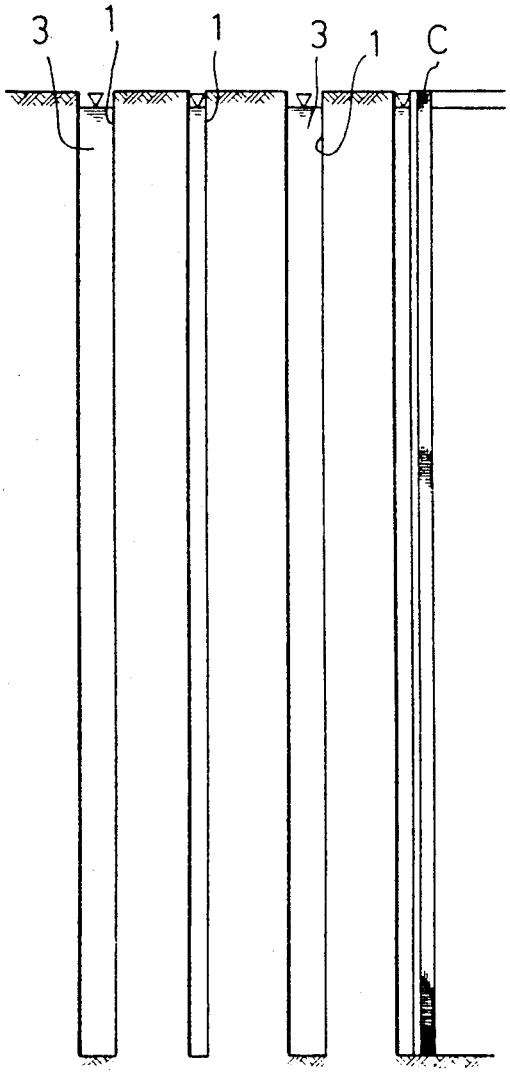
Figure 3B:
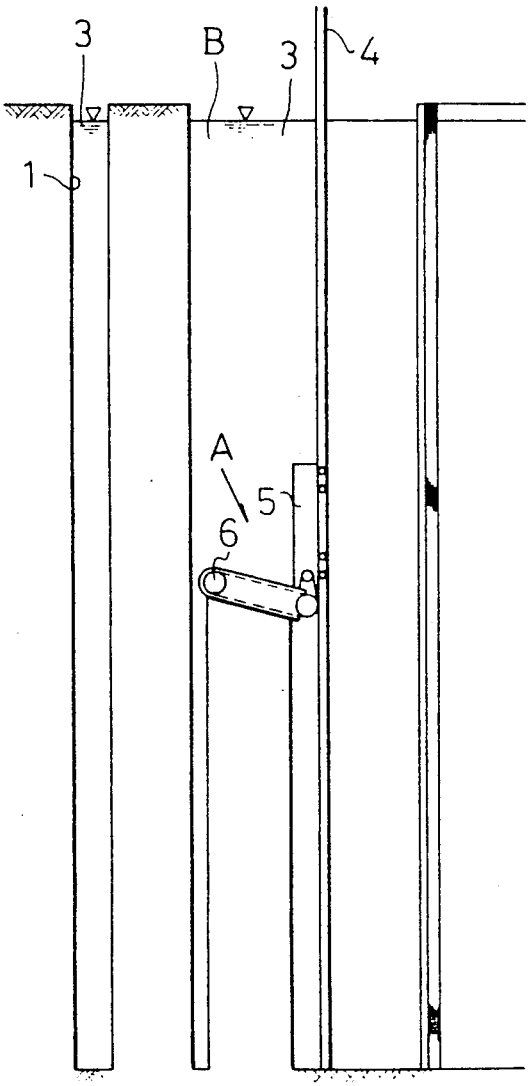
Figure 4A:
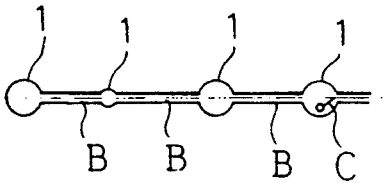
Figure 5A:
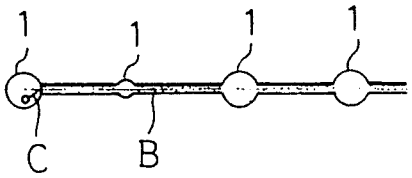
Figure 4B:
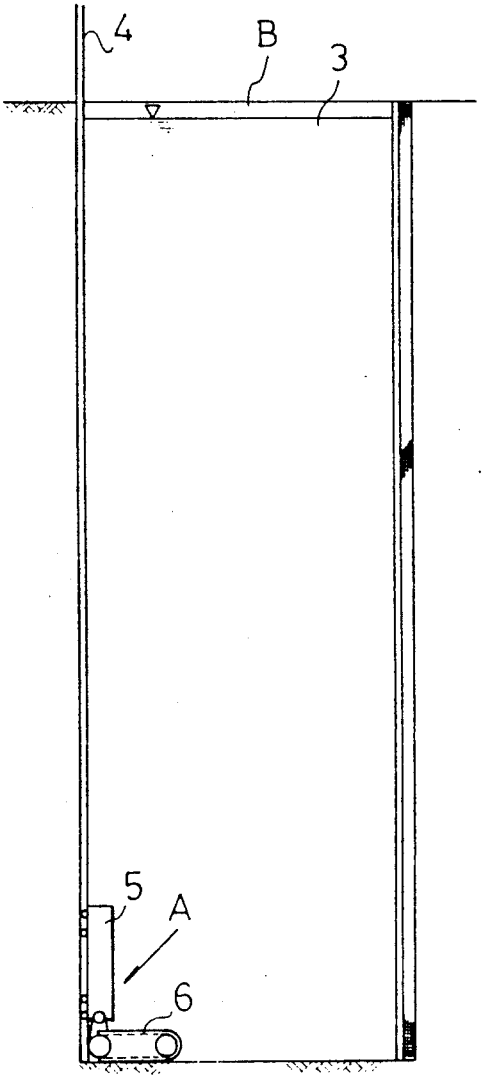
Figure 5B:
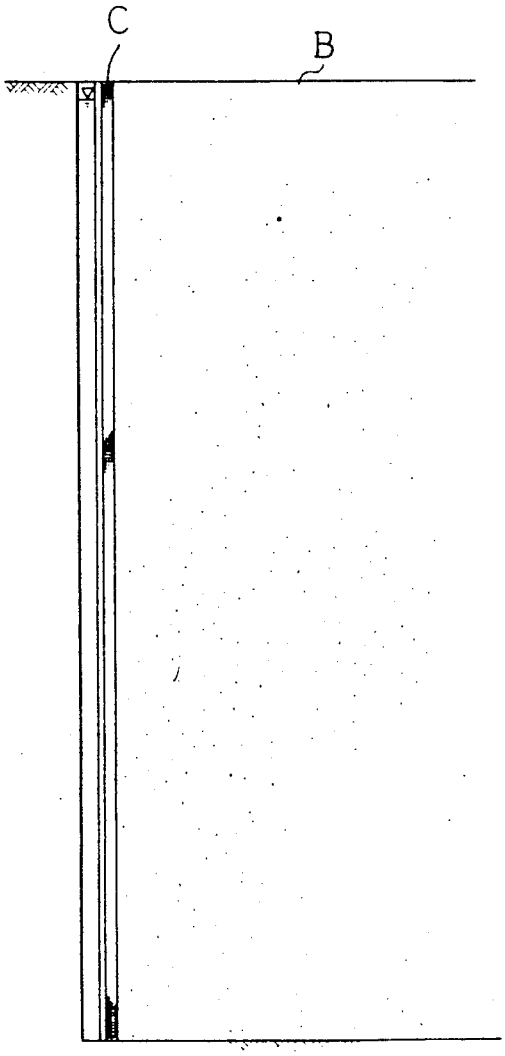
Figure 14:
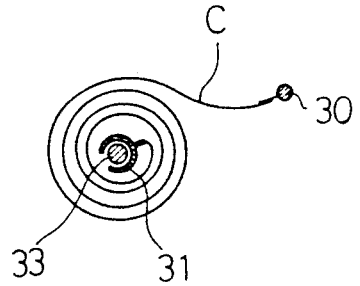
FIG. 14 is a plan view showing the impervious sheet in a state of roll.
Figure 19:
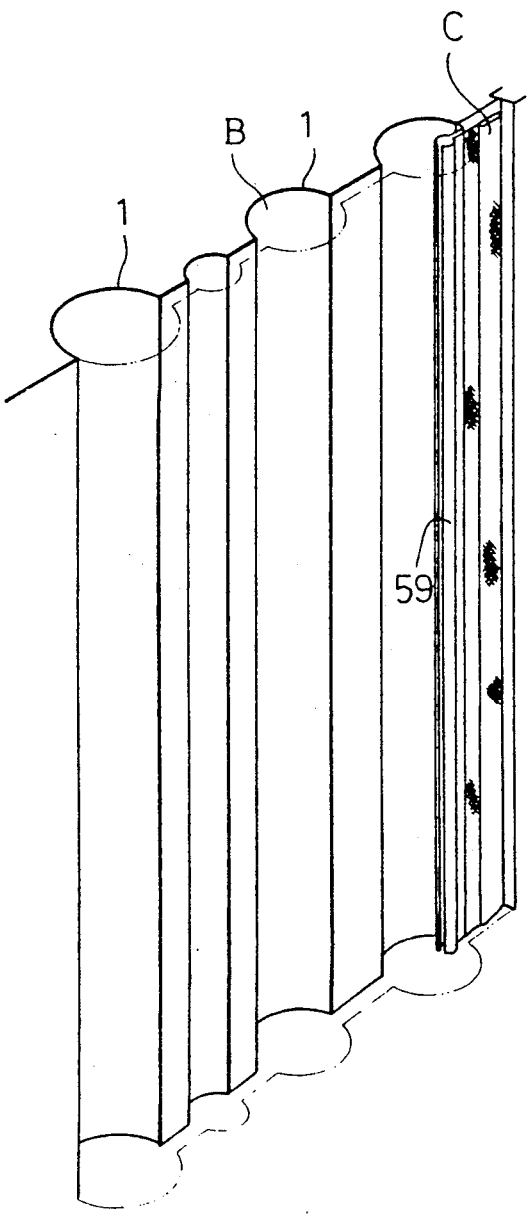
FIGS. 19 to 24 show respectively a still further process of installing an underground continuous impervious wall.
Figure 21:
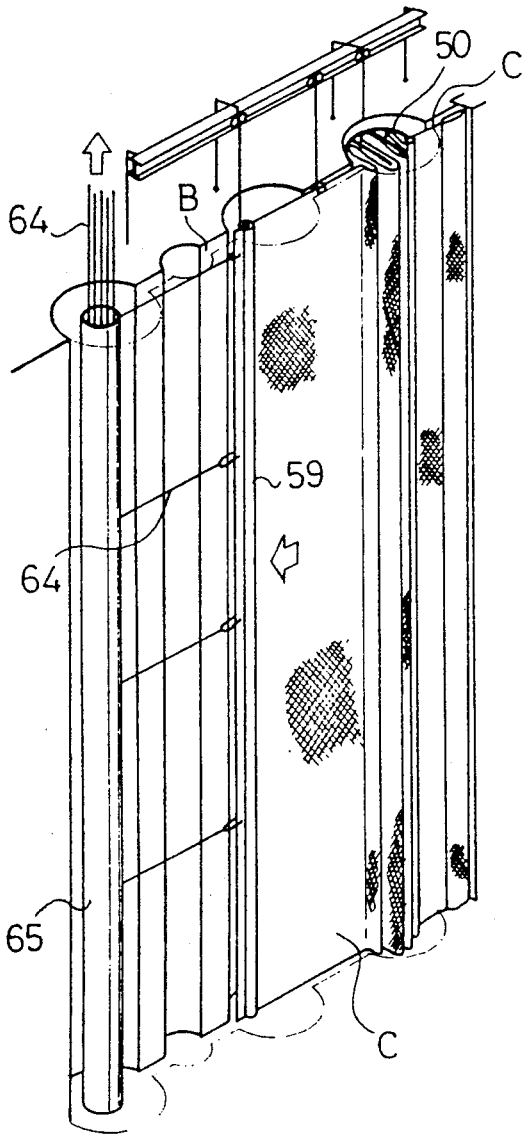
Figure 23:
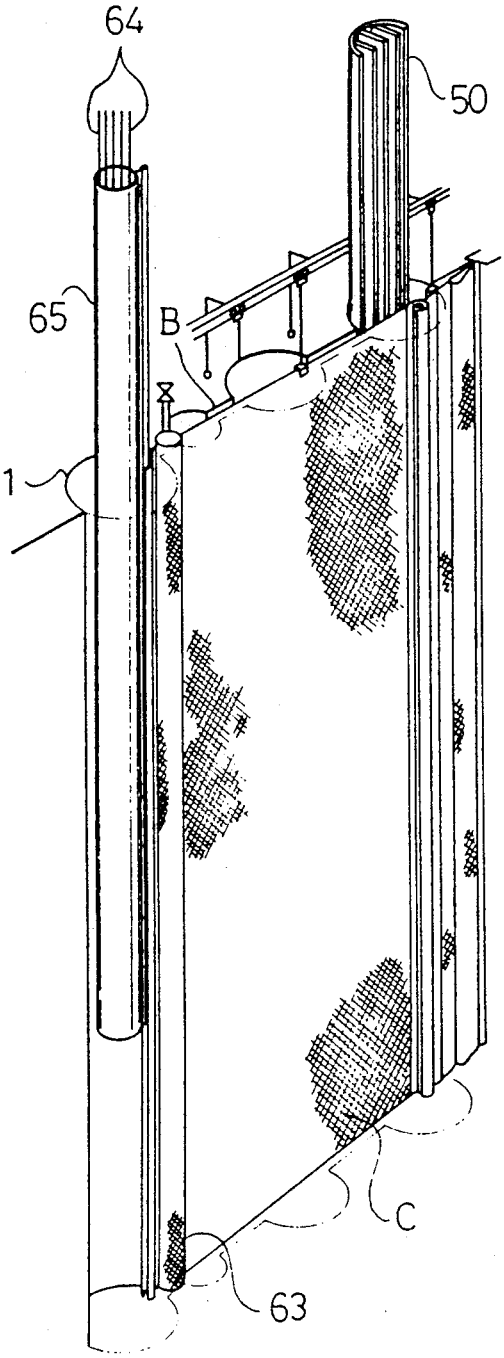
Figure 24:
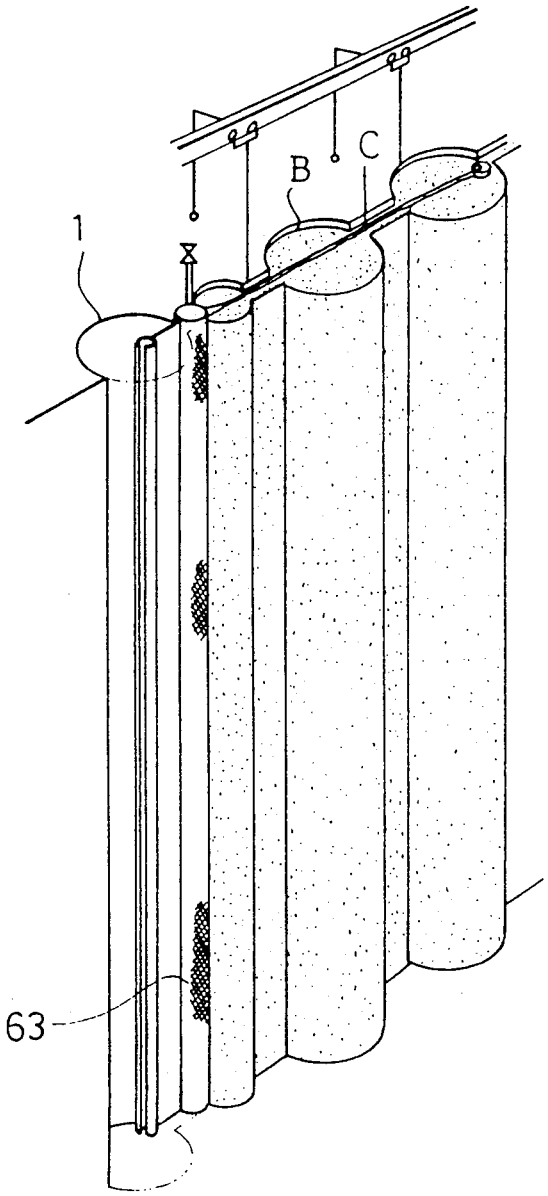
Figure 25:
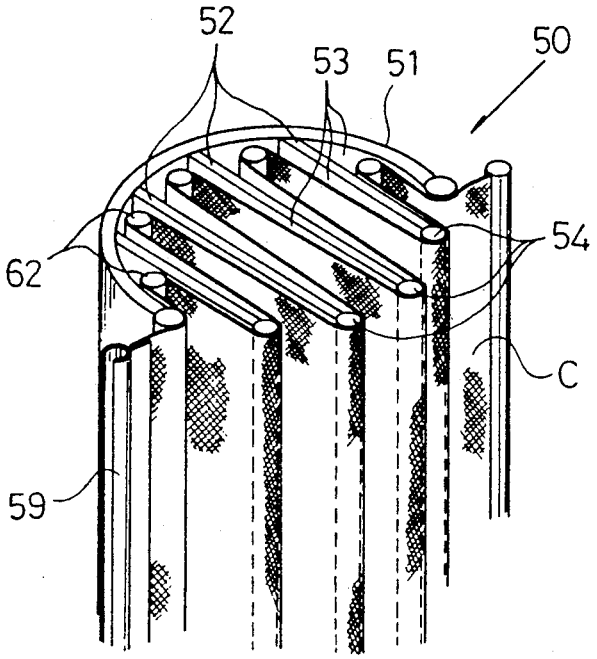
FIG. 25 is a fragmentary perspective view showing an upper portion of a sheet cartridge.
Figure 27A:
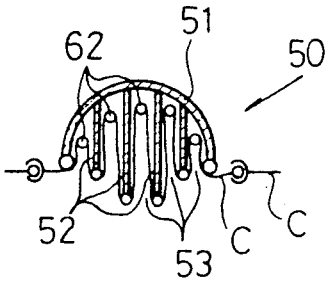
FIG. 27 (I) and (II) are plan views respectively showing a way of paying off the impervious sheet from the cartridge.
Figure 27B:
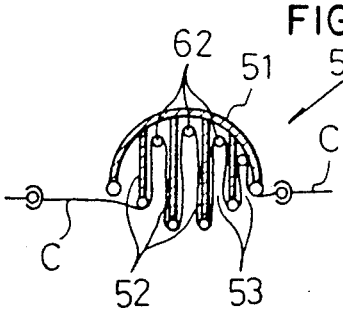
Figure 26:
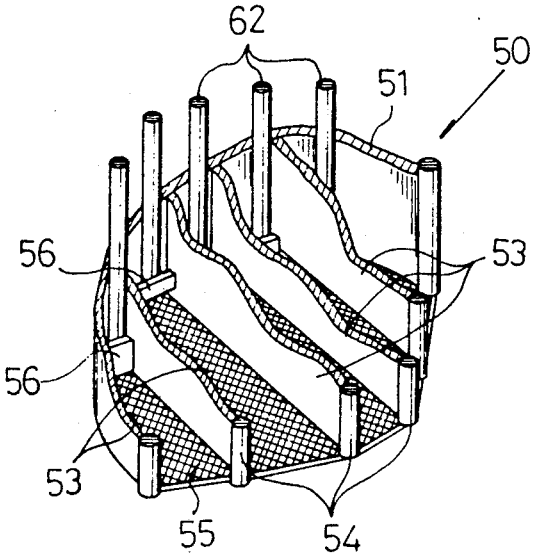
FIG. 26 is a fragmentary perspective view showing a lower portion of the sheet cartridge.
Figure 28:
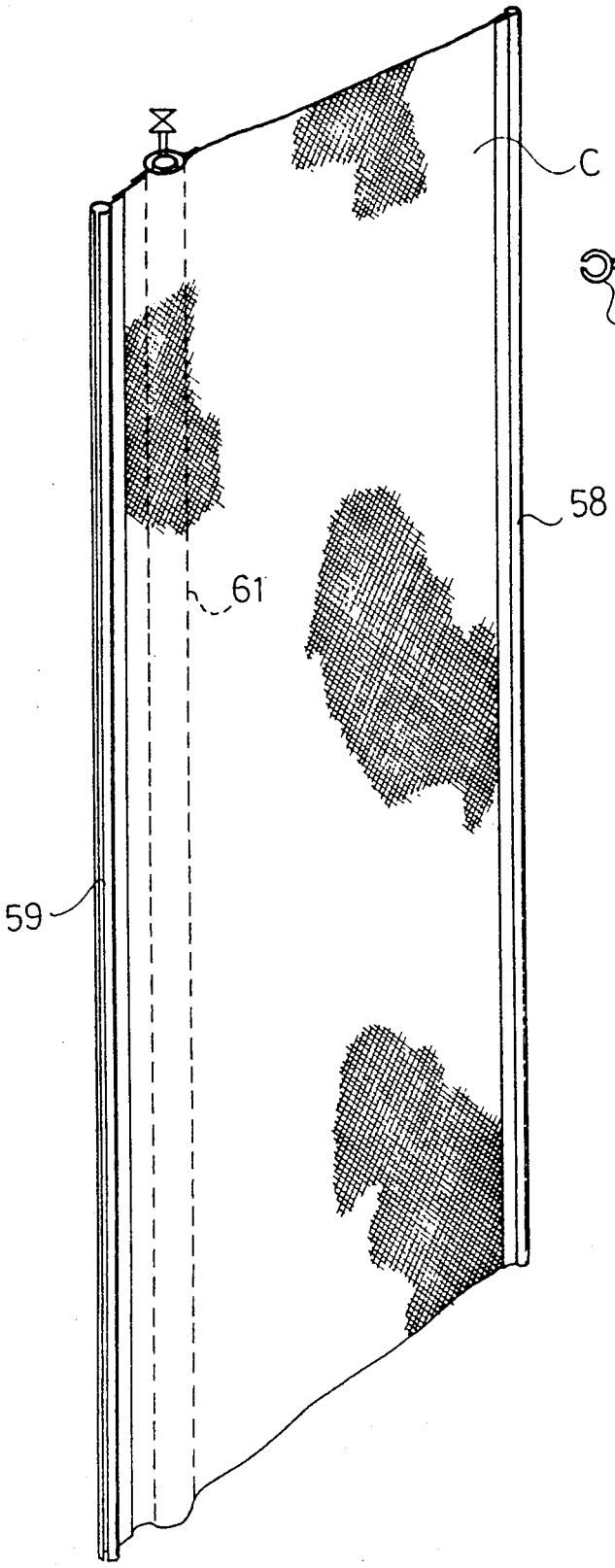
FIG. 28 is a perspective view showing the impervious sheet.
Figure 29:
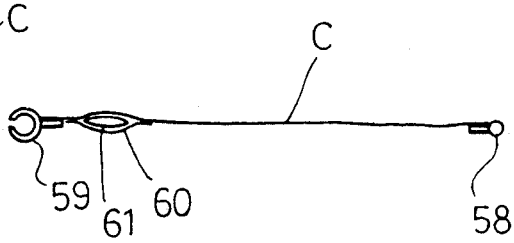
FIG. 29 is a plan view showing the same.
Figure 30:
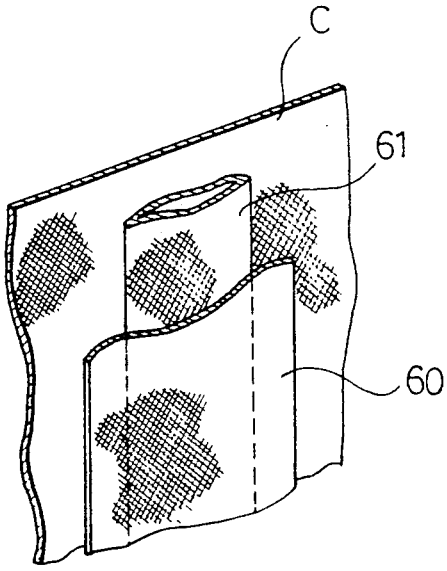
FIG. 30 is a fragmentary perspective view showing the same.
Figure 32A:
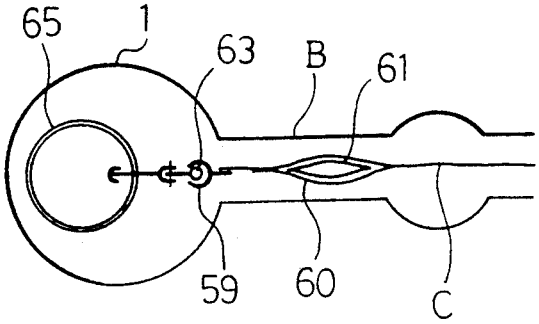
FIGS. 32 (I) and (II) are plan views respectively showing the use of an impervious sheet packer.
Figure 32B:
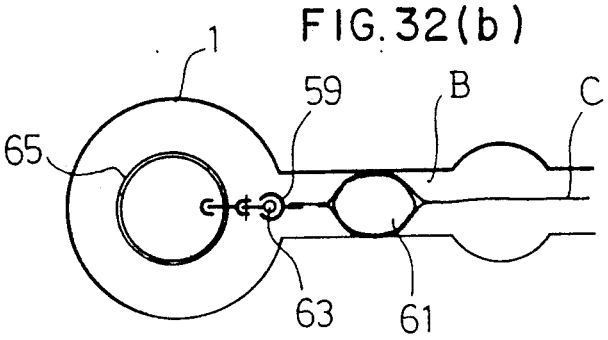

The other objects and features of the present invention will become apparent from the following description of a preferred embodiment of the invention with reference to the accompanying drawings, in which:

FIG. 1 is a perspective view, partially fragmentary, showing an underground continuous water-impervious wall in accordance with a preferred embodiment of the invention;

FIG. 2(*a*) is a schematic plan view of a preliminary step in preparing the earth for trenching in accordance with a preferred embodiment of the invention;

FIG. 2(*b*) is a schematic elevational view of the earth preparation shown in plan view in FIG. 2(*a*);

FIG. 3(*a*) is a schematic plan view of a step in earth preparation subsequent to the step illustrated in FIG. 2(*a*);

FIG. 3(*b*) is a schematic elevational view of the earth preparation shown in plan view in FIG. 3(*a*);

FIG. 4(*a*) is a schematic plan view of a step in earth preparation subsequent to the step illustrated in FIG. 3(*a*);

FIG. 4(*b*) is a schematic elevational view of the earth preparation shown in plan view in FIG. 4(*a*);

FIG. 5(*a*) is a schematic plan view of the completed slit trench shown in preparation in FIGS. 2–4, in which an impervious plastic membrane has been stretched into place;

FIG. 5(*b*) is a schematic elevational view of the slit trench and impervious plastic membrane shown in FIG. 5(*a*);

FIG. 6 is a partially fragmentary elevational perspective view of the trenching apparatus shown schematically in FIG. 3(*b*);

FIG. 7 is an enlarged fragmentary perspective view of the trenching head of the trenching apparatus shown in FIG. 6;

FIG. 8 is an enlarged fragmentary view of the trenching head shown in FIG. 7, but with the protective shroud removed;

FIG. 9(*a*) is a schematic plan view of a slit trench showing therein a rolled sheet of water-impervious plastic membrane;

FIG. 9(*b*) is a schematic elevational view of the slit trench and rolled sheet of water-impervious plastic membrane shown in FIG. 9(*a*);

FIG. 10(*a*) is a schematic plan view of the slit trench shown in FIG. 9(*a*), and further showing therein the water-impervious plastic membrane partially unrolled;

FIG. 10(*b*) is a schematic elevational view of the slit trench and the partially unrolled water-impervious plastic membrane;

FIG. 11(*a*) is a schematic plan view of the slit trench of FIG. 9(*a*) showing the water-impervious plastic membrane fully unrolled;

FIG. 11(*b*) is a schematic elevational view of the slit trench and water-impervious plastic membrane shown in FIG. 11(*a*);

FIG. 12(*a*) is a schematic plan view of the slit trench of FIG. 9(*a*) prior to charging the slit trench with a hardening substance on both sides of the water-impervious plastic membrane;

FIG. 12(*b*) is a schematic elevational view of the slit trench and water-impervious plastic membrane shown in FIG. 12(*a*);

FIG. 13 is a perspective view of the water-impervious plastic membrane used in the invention together with preferred hardware used to deploy the membrane in a slit trench;

FIG. 14 is a plan view of the water-impervious plastic membrane rolled about the hardware shown in FIG. 13;

FIG. 15 is a partially fragmentary perspective view of the rolled water-impervious plastic membrane of FIG. 14 associated with the preferred hardware for unrolling the membrane;

FIG. 16(*a*) is a plan view of another method of installing an underground impervious wall;

FIG. 16(*b*) is an elevational view of the method shown in FIG. 16(*a*);

FIG. 17(*a*) is a plan view of the method shown in FIG. 16(*a*) in a second phase of installation of a water-impervious plastic membrane in a slit trench;

FIG. 17(*b*) is an elevational view of the method shown in FIG. 17(*a*);

FIG. 18(*a*) is a plan view of yet another phase of installation of the method shown in FIG. 17(*a*);

FIG. 18(*b*) is an elevational view of the method shown in FIG. 18(*a*);

FIG. 19 is a perspective view of the first phase of yet another method of installing a water-impervious plastic membrane in a slit trench;

FIG. 20 is a perspective view of a second phase of the method shown as started in FIG. 19;

FIG. 21 is a perspective view of a third phase of the method shown as started in FIG. 19;

FIG. 22 is a perspective view of a fourth phase of the method shown as started in FIG. 19;

FIG. 23 is a perspective view of a fifth phase of the method shown as started in FIG. 19;

FIG. 24 is a perspective view of a sixth phase of the method shown as started in FIG. 19;

FIG. 25 is a fragmentary perspective view showing an upper portion of a sheet cartridge;

FIG. 26 is a fragmentary perspective view showing a lower portion of the sheet cartridge;

FIG. 27(*a*) is a plan view in section of the embodiment of the invention shown in FIG. 25;

FIG. 27(*b*) is a plan view in section similar to FIG. 27(*a*) showing the water-impervious plastic membrane being paid out from the cartridge;

FIG. 28 is a perspective view showing a section of the water-impervious plastic membrane with a bladder tube insert;

FIG. 29 is a plan view of FIG. 28;

FIG. 30 is a fragmentary perspective view of the device shown in FIG. 28 with a modified bladder tube;

FIG. 31 is an elevational view in section showing a steel pipe and membrane stretching means used in a preferred embodiment of the invention;

FIG. 32(*a*) is a schematic plan view of a deflated trench-blocking bladder tube employed as an integral part of the water-impervious plastic membrane;

FIG. 32(*b*) is a schematic plan view of an inflated trench-blocking bladder tube employed as an integral part of the water-impervious plastic membrane;

FIG. 33 is a fragmentary perspective view of a means for interconnecting sheets of water-impervious plastic membrane;

FIG. 34 is a fragmentary perspective view of another means for interconnecting sheets of water-impervious plastic membrane;

FIG. 35 is a sectional plan view of the apparatus shown in perspective in FIG. 34; and FIG. 36 is a partially assembled elevational view of the apparatus shown in FIGS. 34 and 35.

DESCRIPTION OF THE PREFERRED EMBODIMENT

Referring first to FIG. 1, therein is shown a slit trench B in which have been inserted overlapping sheets of stretched water-impervious plastic membranes C which have been stiffened on each side by hardening material D.

FIGS. 2 to 6 illustrate a preferred process of installing an underground continuous impervious wall according to the present invention. The process will now be described step by step.

(1) Boring

A plurality of bore holes 1 are bored at suitable intervals in the ground. The bore holes 1 may not have fixed diameters. It is possible that only a bore hole in which a guide post 4 of an excavating apparatus A is inserted may have an increased diameter. The boring of the bore holes 1 is performed while charging mud 3.

When the boring is done in soil formations consisting of rock, for instance, having satisfactory self-supporting character, mud is unnecessary, and the boring is possible without water.

(2) Excavating apparatus

The excavating apparatus A as shown in FIGS. 6, 7 and 8 comprises a guide post 4, a drive unit 5 and a saw unit 6. The guide post 4 is a hollow pillar-like member having an inner space 7. It has a rack 8 formed on one side over the entire length thereof. A hose 9 for pumping out a slurry of mud and excavated earth is passed through the space 7, so that the slurry can be withdrawn through slurry inlet 10, FIG. 6, formed at the lower end of the guide post 4.

The drive unit 5 is vertically movable along the guide post 4 and is provided on its outer periphery with a plurality of guide rollers 11 in engagement with the guide post 4 for this purpose. The drive unit 5 includes a power unit 12, a control unit 13 and a bracket 14 for mounting a saw. In the power unit 12, a hydraulic pressure tank 15 and a motor-driven hydraulic power unit 16 are accommodated. A movable sprocket 17 and a control box 18 are accommodated in the control unit 13. The movable sprocket 17 is in mesh with the rack 8 of the guide post 4. A drive motor 19 is driven by the motor-driven power unit 12 to rotate the movable sprocket 17 so as to move the drive unit 5 vertically. In the control unit 13, a saw drive motor 20 is also accommodated, and a saw drive sprocket 21 mounted on the saw-mounting bracket 14 is rotated by the motor-driven power unit 12. A saw drive sprocket 22 is mounted on the end of the saw-mounting bracket 14, and an endless saw drive chain 23 is passed around the sprocket 22 and saw drive sprocket 21.

The saw unit 6 includes a saw frame 24 and a chain 25 having teeth 26. The saw frame 24 has one end rotatably mounted on the saw-mounting bracket 14 and rotatable with the saw drive sprocket 22 of the saw-mounting bracket 14. The endless chain 25 is rotatably passed round the saw frame 24. The chain 25 is narrow in width, and it has a plurality of teeth 26 secured to its links constituting the outer periphery of the saw unit 6. The chain 25 is driven for rotation by a chain drive motor 27.

(3) Excavation of the trench

A narrow trench B, FIG. 6, is excavated using the excavating apparatus A as described above. First, the guide post 4 of the excavating apparatus A is installed in a bore hole 1. The movable sprocket 17 is rotated by the drive motor 19 of the drive unit 5 so that it lowers the drive unit 5 along the rack 8 of the guide post 4 in mesh with the movable sprocket 17. The chain 25 is driven by the chain drive motor 27 so that the chain 25 of the saw unit 6 excavates the earth between adjacent bore holes 1. Since the saw unit 6 is narrow, the trench B will have a similar narrow width, and the trench, therefore, can be readily excavated.

The excavation is performed while continuously charging the mud into the trench B. The earth removed by excavation is withdrawn together with mud through inlet 10 at the lower end of the guide post 4 to be discharged to the outside of the trench B through the hose 9. The removed slurry is replaced by the continuous charging of fresh mud into the excavated portion of the trench.

When excavation is difficult, the saw unit 6 is rotated to change its angle of attack by pivotally shifting the saw unit 6 about sprocket 22, FIG. 7.

When excavation is completed to the same depth as the bore hole 1, the orientation of the saw unit 6 in the excavating apparatus A is changed or the guide post 4 is removed and reinstalled in the next bore hole before resuming the excavation.

(4) Stretching of water-impervious sheets

A water-impervious sheet C is stretched in the mud-filled trench B which has been excavated to a predetermined length and depth in the manner described above. An impervious sheet C, not shown, is connected to a joint 28, FIG. 6, of the already stretched impervious sheet C to longitudinally partition the trench B into two narrower lengths.

(5) Solidification of mud

A hardening material D, FIG. 1, is charged into the trench B to solidify the mud 3 that remains in the trench upon completion of excavation, FIG. 3(*b*). Mortar, concrete or the like may be used as the hardening material. When the mud 3 is solidified, an underground continuous impervious wall of narrow width is completed which has the impervious sheet C interposed between the opposite side wall portions.

In the case of soil formations having satisfactory self-supporting character, the mud is unnecessary, and excavation without water is possible. After the stretching of the impervious sheet has been completed, soil mortar is charged in lieu of the mud hardener as filler into the trench.

After the stretching of the impervious sheet has been completed, soil mortar is charged in lieu of the mud hardener as filler into the trench.

(6) Another process

FIGS. 9 to 15 show another process, in which the impervious sheet C is lowered in a wound state on a roller into a trench B. One edge of the impervious sheet C is bonded over the entire length to an elongate bar-like sheet joiner 30. To the other end of the sheet C is bonded an elongate sheet joiner 31 having a C-shaped sectional profile, FIGS. 13 and 14. The impervious sheet C has an inflatable bladder 32 sewed to it near the sheet joiner 31 (FIG. 13).

This impervious sheet C is wound on a joiner 33 serving as a roller. The joiner 33 is elongate, and it has rotatable rings 34 each tied to each of the upper and lower ends. Each of the rings 34 has a wire-mounting projection 35. The joiner 33 is fitted in the sheet joiner 31 having a C-shaped sectional profile. The impervious sheet C is wound on the outer periphery of the joiner 33, as shown in FIG. 14.

Wires 36, FIG. 15, are tied to the respective wire-mounting projections 35 of the joiner 33 and are passed around sheaves 38 in a cylindrical post 37. The wire 36 is stretched upwardly within the post 37.

The impervious sheet C, wound on the joiner 33, and post 37 are lowered into the trench B at a fixed distance from each other. If there is an impervious sheet C which has already been stretched, the newly lowered impervious sheet C is connected to the preceding one by connecting the sheet joiner 31 to the joiner 33 of the preceding one, FIG. 13.

The joiner 33 serving as the roller is pulled toward the post 37 by pulling the wires 36 stretched upwardly within the post 37. The impervious sheet C is paid off from the joiner 33 so that it is stretched in the trench B to longitudinally partition the trench B (FIG. 10).

The trench B is also partitioned transversely by charging water or air into the sewed bladder 32 of the impervious sheet C, FIG. 12(*a*).

A hardening material, e.g., mortar or concrete, is charged into the mud 3 in the trench B partitioned by the bladder 32 to solidify the mud, thus obtaining the impervious wall (FIG. 12). After the mud has been solidified, the post 37 and joiner 33 are pulled out from the trench B.

FIGS. 16 to 18 show a further process in which the impervious sheet C is lowered into the trench in a stretched state between posts. The posts 40 are secured to either the left or right end of one impervious sheet C. Fasteners 41 are tied to the opposite ends of the sheet C over the entire length. A pocket-like bladder 42 is sewed to the impervious sheet C near a post 40. A plurality of impervious sheets C are tied to one another by the fasteners 41. The impervious sheet C is lowered in a folded state together with posts 40 into the trench B. The required number of impervious sheets C, corresponding to the length of the trench B, are paid off to partition the trench B both longitudinally and transversely. Further, additional impervious sheets C are tied together by the fasteners 41, as shown in FIG. 18.

FIGS. 19 to 33 show a still further process, in which the impervious sheet is accordian pleated in a sheet cartridge which is lowered into the trench B.

In FIGS. 25–30, reference numeral 50 designates the sheet cartridge. The cartridge 50, FIG. 25, consists of a shell 51 having a semi-circular sectional profile. Inside the shell 51, a vertically continuous folding groove 53 is formed by a plurality of parallel partition members 52. A rod-like guide member 54 is secured to the free edge of each partition member 52. The cartridge 50 has a bottom, FIG. 26, consisting of an expanded metal 55. Partitioning retainers 56 are secured to the bottom 55 near the shell 51 to partition the folding groove 53. As shown in FIG. 28, the impervious sheet C has an elongate rod-like sheet joiner 58 secured to one end and a sheet joiner 59, having a C-shaped sectional profile, secured to the other end. The impervious sheet C also has a pocket-like cover 60 bonded to it near the sheet joiner 59. An elongate trench-blocking bladder 61 is inserted in the cover 60.

The impervious sheet C is formed in a folded state in the folding groove 53 of the sheet cartridge 50, FIG. 25. Each folded portion of the impervious sheet C extends to the bottom of each section of the folding groove 53. In the folded portion, a space rod 62 is provided between each partitioning retainer 56 and the shell 51 to prevent detachment of the impervious sheet.

The impervious sheet C is lowered, after being folded into the cartridge 50, into the trench B. The elongate joiner 58 is fitted within the sheet joiner 59 of the impervious sheet C (FIG. 33). A plurality of wires 64 are tied to the joiner 58, and passed around sheaves 66 in a post 65 to be pulled upwards (FIG. 31).

When lowering the sheet cartridge 50 into the trench B, the post 65 is also lowered into the trench B parallel to the cartridge (FIG. 20). If there is an already stretched impervious sheet C in the trench B, the new impervious sheet C is lowered with its sheet joiner 59 engaged in the sheet joiner 58 of the preceding sheet, whereby the two sheets C are joined together by the sheet joiners 58 and 59, FIG. 33.

After the sheet has been lowered in cartridge 50, the wires 64 are passed through the post 65 and are tensioned to extend the lowered impervious sheet C. Thereafter, the space rods 62 are withdrawn one by one so that the impervious sheet C may be paid off from the folding groove 53 as shown in FIG. 27(*a*) and FIG. 27(*b*). The impervious sheet C is then stretched in the trench B such that it partitions the trench B as previously described (FIG. 22). Air or water is charged into the bladder 61 of the stretched impervious sheet C to transversely partition the trench B. Hardening material D is next poured into the partitioned trench B to solidify the mud 3.

FIGS. 34 to 36 show another means for connecting the impervious sheets C. A bar-like weight 70, FIG. 36, is secured to the lower edge of the impervious sheet C. A plurality of impervious sheets are introduced one by one into the trench B. The trailing end of each preceding impervious sheet C is provided with a vertically continuous channel-shaped hook 71. To the leading end of the impervious sheet C are secured a plurality of clips 72 adapted to engage hook member 71. In the alternative, a single elongated clip may be adapted to continuously engage hook 71.

The impervious sheet C is lowered in a state suspended from a bar-like hanger 73, FIG. 36, into the trench B by a crane or the like. When introducing a subsequent impervious sheet C to a preceding impervious sheet C, the clip 72 of the subsequent impervious sheet C is engaged in the hook 71 of the preceding impervious sheet C. In this manner, a plurality of impervious sheets C are continuously connected and introduced into the trench B to partition the trench B both longitudinally and transversely.

When solidifying the mud, the trench B may be partitioned by driving locking pipes 74 in the trench in order that a given solidification range of trench is delimited so as to keep the last set of hooks 71 and clips 72 free from solidified mud while impervious sheets are still being placed in the open end of trench B.

Numerous modifications and variations of the subject invention may occur to those skilled in the art upon a study of this disclosure. It is therefore to be understood that, within the scope of the appended claims, the invention may be practiced otherwise than as described in the specification and illustrated in the drawings.

What is claimed is:

1. In a slit trench having opposed walls, the method for installing an underground water-impervious wall comprising the steps of:

(a) placing a series of interconnected sheets of water-impervious membrane in said slit trench;

(b) positioning first and second supporting rods vertically in said slit trench;

(c) vertically suspending said sheets between said first and second supporting rods;

(d) sequentially positioning and tensioning each sheet in said trench;

(e) securing one vertical edge of each said sheet to said first supporting rod;

(f) securing the opposite vertical edge of said sheet to said second supporting rod;

(g) anchoring said first supporting rod;

(h) shifting said second supporting rod away from said first supporting rod to tension said sheet;

(i) securing a vertically elongated bladder pocket to at least one of said sheets;

(j) placing a vertically elongated inflatable bladder in said pocket; and (k) inflating said bladder to laterally expand said bladder pocket sufficiently to create a dam between said opposed trench walls.

2. The method of constructing an underground water-impervious wall in a slit trench comprising the steps of:

(a) boring a plurality of holes at preselected intervals along the center line of the proposed wall;

(b) charging said holes with fluidized mud simultaneously with the boring thereof;

(c) placing a hollow tube in one of said bore holes positioned to receive a slurry of excavated earth and mud into the bottom of said tube and to discharge said slurry out of the top of said tube;

(d) mounting a cantilevered excavating head on said tube adapted to excavate the earth between a pair of bore holes and to transport said earth into said bore hole containing said hollow tube;

(e) urging said cantilevered excavating head downwardly along said tube until all earth has been excavated between said pair of bore holes;

(f) consecutively excavating the earth between said holes to from a continuous slit trench while simultaneously charging said slit trench portion so formed with fluidized mud;

(g) removing a slurry of fluidized mud and excavated earth from said slit trench;

(h) continuously replacing the slurry removed from said trench during excavation with fluidized mud;

(i) positioning and stretching in a vertical plane a water-impervious membrane throughout said fluidized mud-filled trench; and (j) charging a substance on opposite sides of said membrane to harden said fluidized mud.

3. The method of claim 2 wherein said membrane is comprised of a plurality of sheets of membrane, and including the steps of:

(a) consecutively positioning said plurality of sheets of membrane in edge-to-edge continuous, unbroken, longitudinal alignment throughout said trench;

(b) stretching each sheet prior to connecting said sheet to a consecutively adjacent next sheet; and (c) connecting adjacent edges of said sheets to form a continuous sheet of membrane.

4. The method of claim 2, wherein said cantilevered excavating head comprises a rotating chain with cutting teeth secured thereto, said chain being mounted to rotate on a rigid mandrel vertically shiftably secured to said hollow tube, and of sufficient length to fully excavate between bore holes, including the steps of:

(a) horizontally positioning said mandrel;

(b) rotating said chain on said mandrel;

(c) urging said mandrel downwardly to engage and to excavate earth laterally into said hollow tube-containing bore hole to form a slurry of fluidized mud and earth;

(d) withdrawing said slurry up the interior of said hollow tube;

(e) discharging said slurry remote from said trench; and (f) replacing fluidized mud into said trench at the same volumetric rate as the rate at which said slurry is removed from said bore hole.

* * * * *